US010633977B2

(12) United States Patent
Takamura et al.

(10) Patent No.: US 10,633,977 B2
(45) Date of Patent: Apr. 28, 2020

(54) BLADE, GAS TURBINE EQUIPPED WITH SAME, AND BLADE MANUFACTURING METHOD

(71) Applicant: Mitsubishi Hitachi Power Systems, Ltd., Kanagawa (JP)

(72) Inventors: Keita Takamura, Yokohama (JP); Saki Matsuo, Yokohama (JP); Yoshifumi Tsuji, Yokohama (JP); Satoshi Hada, Yokohama (JP); Hidekatsu Atsumi, Yokohama (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 114 days.

(21) Appl. No.: 15/763,245

(22) PCT Filed: Oct. 19, 2016

(86) PCT No.: PCT/JP2016/080939

§ 371 (c)(1),
(2) Date: Mar. 26, 2018

(87) PCT Pub. No.: WO2017/069145

PCT Pub. Date: Apr. 27, 2017

(65) Prior Publication Data

US 2018/0274371 A1 Sep. 27, 2018

(30) Foreign Application Priority Data

Oct. 22, 2015 (JP) ..... 2015-207873

(51) Int. Cl.
*F01D 5/18* (2006.01)
*B22C 9/10* (2006.01)

(52) U.S. Cl.
CPC ..... *F01D 5/186* (2013.01); *B22C 9/10* (2013.01); *F01D 5/187* (2013.01);
(Continued)

(58) Field of Classification Search
CPC ..... F01D 5/186; F01D 5/187
See application file for complete search history.

(56) References Cited

U.S. PATENT DOCUMENTS 4,312,625 A 1/1982 Pinaire
7,416,391 B2 * 8/2008 Veltre ..... F01D 5/187 416/193 A (Continued)

FOREIGN PATENT DOCUMENTS

CN 102444430 5/2012
CN 103184893 7/2013

(Continued)

OTHER PUBLICATIONS

International Search Report dated Nov. 22, 2016 in International (PCT) Application No. PCT/JP2016/080939.

(Continued)

*Primary Examiner* — David E Sosnowski
*Assistant Examiner* — Sabbir Hasan
(74) *Attorney, Agent, or Firm* — Wenderoth, Lind & Ponack, L.L.P.

(57) ABSTRACT

An end plate of a blade has a gas path surface facing a combustion gas channel side, an end surface along an edge of the gas path surface, a plurality of channels, and a skirt hole. The plurality of channels extend along the direction of a partial end surface, which is a portion of the end surface, and are arranged in a perspective direction with respect to the partial end surface. The skirt hole opens at the partial end surface. The skirt hole communicates with an inside channel, which is the channel of the plurality of channels that is farthest from the partial end surface.

9 Claims, 16 Drawing Sheets

(52) U.S. Cl.
CPC .... *F05D 2230/21* (2013.01); *F05D 2230/211* (2013.01); *F05D 2240/81* (2013.01); *F05D 2250/185* (2013.01); *F05D 2260/202* (2013.01)

(56) References Cited

U.S. PATENT DOCUMENTS

| | | | | |
|---|---|---|---|---|
| 8,444,381 | B2 * | 5/2013 | Seely | F01D 5/082 415/1 |
| 8,794,921 | B2 * | 8/2014 | Ellis | F01D 5/087 29/525 |
| 8,858,160 | B2 | 10/2014 | Walunj et al. | |
| 8,905,714 | B2 | 12/2014 | Ellis et al. | |
| 9,249,674 | B2 * | 2/2016 | Ellis | F01D 5/187 |
| 2009/0304520 | A1 | 12/2009 | Brittingham et al. | |
| 2012/0034102 | A1 | 2/2012 | Boyer | |
| 2012/0082566 | A1 | 4/2012 | Ellis et al. | |
| 2013/0052009 | A1 | 2/2013 | Smith et al. | |
| 2013/0115059 | A1 | 5/2013 | Walunj et al. | |
| 2013/0171004 | A1 | 7/2013 | Ellis et al. | |
| 2013/0171005 | A1 | 7/2013 | Ellis et al. | |
| 2014/0072400 | A1 | 3/2014 | Dillard et al. | |

FOREIGN PATENT DOCUMENTS

| | | |
|---|---|---|
| CN | 103184895 | 7/2013 |
| DE | 10361882 | 7/2005 |
| JP | 11-166401 | 6/1999 |
| JP | 2000-220404 | 8/2000 |
| JP | 3073404 | 8/2000 |
| JP | 2007-327493 | 12/2007 |
| JP | 2012-36888 | 2/2012 |
| JP | 2012-077744 | 4/2012 |
| JP | 2013-139772 | 7/2013 |
| JP | 2013-139791 | 7/2013 |
| JP | 2014-51981 | 3/2014 |

OTHER PUBLICATIONS

Written Opinion of the International Searching Authority dated Nov. 22, 2016 in International (PCT) Application No. PCT/JP2016/080939.

* cited by examiner

BLADE, GAS TURBINE EQUIPPED WITH SAME, AND BLADE MANUFACTURING METHOD

TECHNICAL FIELD

The present invention relates to a blade, a gas turbine equipped with this blade, and a blade manufacturing method.

This application claims priority based on JP 2015-207873 filed in Japan on Oct. 22, 2015, of which the contents are incorporated herein by reference.

BACKGROUND ART

The gas turbine includes a rotor that rotates around an axial line, and a casing that covers the rotor. The rotor includes a rotor shaft and a plurality of blades that are attached to the rotor shaft. Furthermore, a plurality of vanes are attached to the inner circumferential side of the casing. The blade includes a blade body with an airfoil shape, a platform that extends in essentially a perpendicular direction with respect to the blade height direction from an end portion in the blade height direction of the blade body, and a shaft attachment portion that extends from the platform to the opposite side as the blade body.

The blades and vanes of the gas turbine are exposed to high temperature combustion gas. Therefore, the blades and vanes are generally cooled by air or the like.

For example, various types of cooling channels through which cooling airflow are formed in the rotating blade described in the following Patent Document 1. Specifically, blade channels where cooling air flows, with an interior that extends in the blade height direction are formed in the blade body, platform, and shaft attachment part. A gas path surface facing in the blade height direction and that contacts the combustion gas, a reverse gas path surface with a back matching relationship to the gas path surface, and an end surface along an edge of the gas path surface are formed in the platform. Furthermore, a platform channel where cooling gas flows is formed in the platform. The platform channel is a serpentine channel. The serpentine channel has a plurality of channels extending in a specific direction and arranged in a perpendicular direction to the specific direction. The serpentine channel forms a channel where ends of a plurality of channels are mutually connected to form an overall zigzag channel.

CITATION LIST

Patent Document

Patent Document 1: JP3073404 B

SUMMARY OF INVENTION

Technical Problem

The rotating blade according to Patent Document 1 is generally manufactured by the following procedure.

(1) A mold is formed with an internal space that matches the external shape of the rotating blade.

(2) A channel core with an external shape that matches the shape of the platform channel and a skirt core that supports the channel core in the mold are formed.

(3) The channel core and the skirt core are placed in the mold, and molten metal is injected into the mold.

(4) After the molten metal hardens, the channel core and the skirt core are dissolved.

In addition to the platform channel where cooling air flows, a skirt hole is formed in a portion where the skirt core that was placed in the mold in the manufacturing step existed in the platform which is the end plate of the rotating blade manufactured by the above procedure.

The skirt hole of the platform which is the end plate is formed because of manufacturing requirements. However, a large stress is generated in the rotating blade because this skirt hole is formed in the rotating blade.

Accordingly, an object of the present invention is to provide a blade that can suppress the occurrence of high stress even though a plurality of channels are formed in the end plate, as well as a gas turbine having the blade, and a method of manufacturing the blade.

Solution to Problems

The blade of the first embodiment of the invention for achieving the aforementioned objective includes:

a blade body with an airfoil shape, disposed in a combustion gas channel where combustion gas flows; and an end plate formed on an end portion in the blade height direction of the blade body;

the end plate including:

a gas path surface facing a side of the combustion gas channel;

a reverse gas path surface facing a side opposing the gas path surface;

an end surface along an edge of the gas path surface;

a plurality of channels that extend in a direction along the gas path surface, disposed between the gas path surface and the reverse gas path surface; and a skirt hole opened in a partial end surface that is a portion of the end surface;

wherein the plurality of channels are aligned in a perspective direction with respect to the partial end surface; and of the plurality of channels, the skirt hole communicates with an inside channel that is farther from the partial end surface than an outside channel that is near the partial end surface.

With this blade, a skirt hole is open in the partial end surface of the end plate. Therefore, stress occurs near the partial end surface where the skirt hole opening is formed in the blade. However, the outer circumferential side portion of the end plate is essentially a free end, so the stress that occurs in the side end portion including the partial end surface of the end plate is extremely small. Therefore, this blade can suppress damage near the opening of the skirt hole.

Furthermore, with this blade, cooling air that flows through the inside channel can pass through the skirt hole and be discharged from the partial end surface of the end plate. in other words, with this blade, the skirt hole can be used as an air channel for the cooling air to pass through. The cooling air that has been discharged from the partial end surface of the end plate cools the partial end surface.

The blade according to embodiment 2 of the present invention for achieving the aforementioned object is the blade according to the first embodiment, wherein the skirt hole partially overlaps the outside channel as seen from the blade height direction, and the position in the blade height direction of a portion of the skirt holes differs from the position in the blade height direction of the outside channel.

The blade according to embodiment 2 of the present invention for achieving the aforementioned object is the blade according to the first embodiment, wherein the skirt hole partially overlaps the outside channel as seen from the blade height direction, and the position in the blade height direction of a portion of the skirt holes differs from the position in the blade height direction of the outside channel.

With this blade, the plurality of channels passed through closer to the gas path surface side than the skirt hole. Therefore, with this blade, the gas path surface of the end plate can be effectively cooled by the cooling air that passes through the plurality of channels.

The blade according to the fourth embodiment of the present invention for achieving the aforementioned object is the blade according to the third embodiment, wherein the skirt hole includes a first extending part that extends from the inside channel to the reverse gas path surface side, and a second extending part that extends from the end portion on the reverse gas path surface side toward the partial end surface, in the first extending part.

The blade according to the fifth embodiment of the present invention for achieving the aforementioned object is the blade according to the third embodiment, wherein the skirt hole includes a tilted hole part that gradually, approaches the reverse gas path surface side when approaching the partial end surface from the inside channel.

The inside channel of the blade may be inspected by inserting a borescope inside. With this blade, the borescope can easily be inserted into the inside channel from the skirt hole. Therefore, with this blade, inspection of the inside channel can easily be performed.

The blade according to the sixth embodiment of the present invention for achieving the aforementioned object is the blade according to any one of the third through fifth embodiments, wherein the inside channel has an expanded part that expands closer to the reverse gas path surface side than the outside channel, and the skirt hole communicates with the expanded part of the inside channel.

With this blade as well, the borescope can easily be inserted into the inside channel from the skirt hole. Therefore, with this blade as well, inspection of the inside channel can easily be performed.

The blade according to the seventh embodiment of the present invention for achieving the aforementioned object is the blade according to any one of the first through sixth embodiments, having a plug that blocks the opening of the skirt hole in the partial end surface.

If cooling of the partially end surface by cooling air from the skirt hole is not necessary, the opening of the skirt hole in the partially end surface may be blocked by the plug. With this rotating blade, the centrifugal force toward the outer side in the radial direction acts on the plug when the gas turbine rotor rotates. With this rotating blades, the plug is received by the inner surface of the skirt hole even if there is an attempt to move the plug in the outward radial direction by the centrifugal force, and therefore removal from the skirt hole is difficult. Therefore, the rotating blade can suppress damage to the end plate.

The blade according to the eighth embodiment of the present invention for achieving the aforementioned object is the blade according to any one of the seventh embodiment, wherein the plug has a through hole that discharges the cooling air in the skirt hole to the outside.

With this blade, the flow of cooling air discharged from the partial end surface can be appropriately adjusted by appropriately adjusting the inner diameter of the through hole. Therefore, with this blade, the amount of cooling air that is used can be controlled while appropriately cooling the partial end surface.

The blade according to the ninth embodiment of the present invention for achieving the aforementioned object is the blade according into any one of the first through eighth embodiments, wherein each of the plurality of channels extends in the direction along the partial end surface and communicates with a channel that is adjacent in the perspective direction, at an end in the direction along the partial end surface, and thereby the plurality of channels mutually communicate and form one serpentine channel.

The gas turbine according to the 10th embodiment of the present invention for achieving the aforementioned object, includes: a plurality of the blades according to any one of the first through ninth embodiments; a rotor shaft to which a plurality of blades are attached;

a casing that covers the plurality of blades and the rotor shaft; and a combustor that transfers combustion gas to a region where the plurality of blades are disposed in the casing.

With the manufacturing method for a blade according to the 11th embodiment of the present invention for achieving the aforementioned objective, the blade has a blade body with an airfoil shape, disposed in the combustion gas channel where the combustion gas flows, and an end plate that extends from the end portion in the blade height direction of the blade body in a direction having a perpendicular component with respect to the blade height direction; the end plate has a gas path surface facing the combustion gas channel side, a reverse gas path surface facing the side opposing the gas path surface, and an air space where the cooling air flows; and the method includes: a mold forming step of forming a mold that forms an internal space that matches the external shape of the blade; a core forming step of forming a core with an external shape that matches the shape of the air space in the end plate; a casting step where molten metal flows into the mold with the core provided in the mold; and a core dissolving step of dissolving the core after hardening the molten metal;

in the core forming step, the core is formed by: a channel core disposed between the gas bath surface and the reverse gas path surface at the end plate, extending in a direction along the gas path surface, and forming each of the plurality of channels aligned in the perspective direction with respect to the partial end surface which is a portion of the end surface; and a skirt core that forms a skirt hole that opens in the partial end surface and communicates with an inside channel farther from the partial end surface than the outside channel that is close to the partial end surface, of the plurality of channels.

The manufacturing method for a blade according to the 12th embodiment of the invention for achieving the aforementioned objective is the manufacturing method for a blade according to the 11th embodiment, wherein a sealing step that blocks the opening of the skirt hole in the partial end surface using a plug, after the core dissolving step.

Advantageous Effects of Invention

According to one aspect of the present invention, the high stress that occurs in the blade can be suppressed.

DESCRIPTION OF EMBODIMENTS

The following describes in detail the embodiments and various variant examples of the present invention, with reference to the drawings.

First Embodiment

Figure 1:
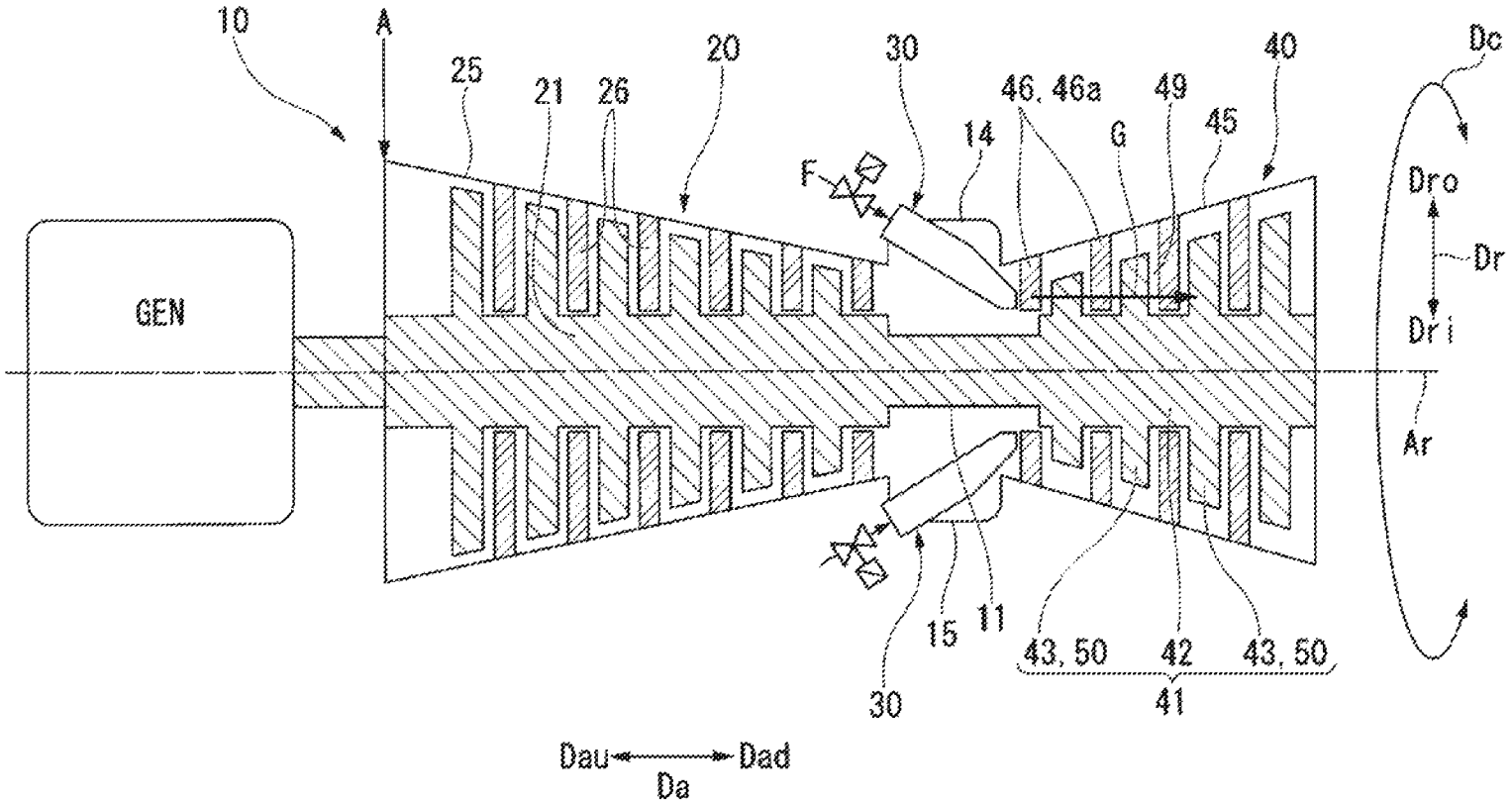
FIG. 1 is a schematic cross-sectional view illustrating the gas turbine of the first embodiment according to the present invention.

A gas turbine 10 as the first embodiment of the present invention includes a compressor 20 that compresses air A, a combustor 30 that generates a combustion gas G by burning a fuel F in the air A compressed by the compressor 20, and a turbine 40 driven by the combustion gas G, as illustrated in FIG. 1.

The compressor 20 includes a compressor rotor 21 that rotates around an axial line Ar, a compressor casing 25 that covers the compressor rotor 21, and a plurality of vane rows 26. The turbine 40 includes a turbine rotor 41 that rotates around the rotational axial line Ar, a turbine casing 45 that covers the turbine rotor 41, and a plurality of vane rows 46.

The compressor rotor 21 and the turbine rotor 41 are positioned on the same axial line Ar and connected with each other to form the gas turbine rotor 11. A rotor of a generator GEN is connected to this gas turbine rotor 11, for example. The gas turbine 10 also includes an intermediate casing 14 provided between the compressor casing 25 and the turbine casing 45. The combustor 30 is attached to the intermediate casing 14. The compressor casing 25, intermediate casing 14, and the turbine casing 45 are connected with each other to form a gas turbine casing 15. Note that in the following, the direction that the axial line Ar stands is the axial direction Da, a circumferential direction around this axial line Ar is simply referred to as a circumferential direction Dc, and a direction orthogonal to the axial line Ar is referred to as a radial direction Dr. Furthermore, the compressor 20 side of the turbine 40 in the axial direction Da is referred to as the "upstream side Dau", and the side opposite to this side as the "downstream side Dad". Furthermore, the side closer to the axial line Ar in the radial direction Dr is referred to as the "radial direction inward side Dri", and the opposite side is the "radial direction outward side Dro".

The turbine rotor 41 includes a rotor shaft 42 that is centered around the axial line Ar and extends in the axial direction Da, and a plurality of rotor blade rows 43 attached to this rotor shaft 42. The plurality of rotor blade rows 43 are arranged in the axial direction Da. Each of the rotor blade rows 43 includes a plurality of rotor blades 50 arranged in the circumferential direction Dc. The vane rows 46 are respectively disposed on the upstream side Dau of each of the plurality of rotor blade rows 43. Each of the vane rows 46 is provided on an inner side of the turbine casing 45. Each of the vane rows 46 includes a plurality of vanes **46*a*** arranged in the circumferential direction Dc.

A combustion gas flow channel 49 through which combustion gas G from the combustor 30 flows is formed in an annular space between an outer peripheral side of the rotor shaft 42 and an inner peripheral side of the turbine casing 45 in a region where the vane **46*a* and the rotor blade rows 50 are disposed in the axial direction Da. The combustion gas channel 49** forms a ring around the axial line Ar, extending in the axial direction Da.

Figure 2:
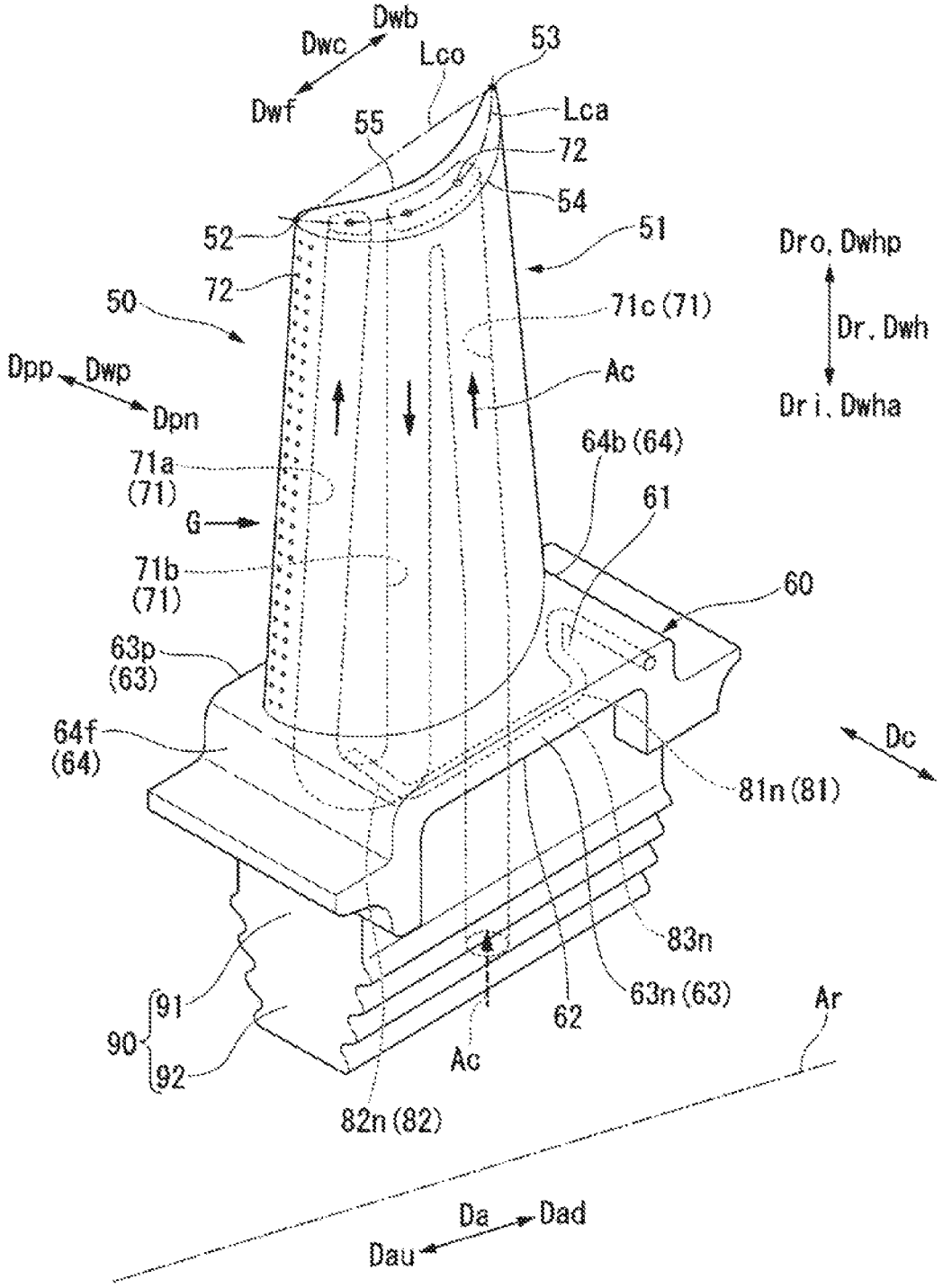
FIG. 2 is a perspective view of the rotating blade of the first embodiment of the present invention.

As illustrated in FIG. 2, the rotating blade 50 includes a blade body 51 with an airfoil shape, a platform 60 provided on an end portion of the blade body 51 in the blade height direction Dwh, and a shaft attachment part 90 that extends to the opposite side as the blade body 51 from the platform 60. The blade height direction Dwh is essentially the same direction as the radial direction Dr in a condition where the rotating blade 50 is attached to the rotor shaft 42. Therefore, in this condition, the blade body 51 exists on the radial direction outward side Dro and the shaft attachment part 90 exists on the radial direction inward side Dri, with reference to the platform 60.

The blade body 51 is provided in the combustion gas channel 49. The blade body 51 is configured of a back side surface (negative pressure surface) 54 which is a convex surface and a front side surface (positive pressure surface) 55 which is a concave surface. The back side surface 54 and the front side surface 55 are connected by the leading edge 52 and the trailing edge 53 of the blade body 51. With the rotating blade 50 attached to the rotor shall 42, the leading edge 52 is located on the upstream side Dau of the axial direction Da with respect to the trailing edge 53. Furthermore, under this condition, the back side surface 54 and the front side surface 55 face any direction having a component of the circumferential direction Dc.

Figure 4:
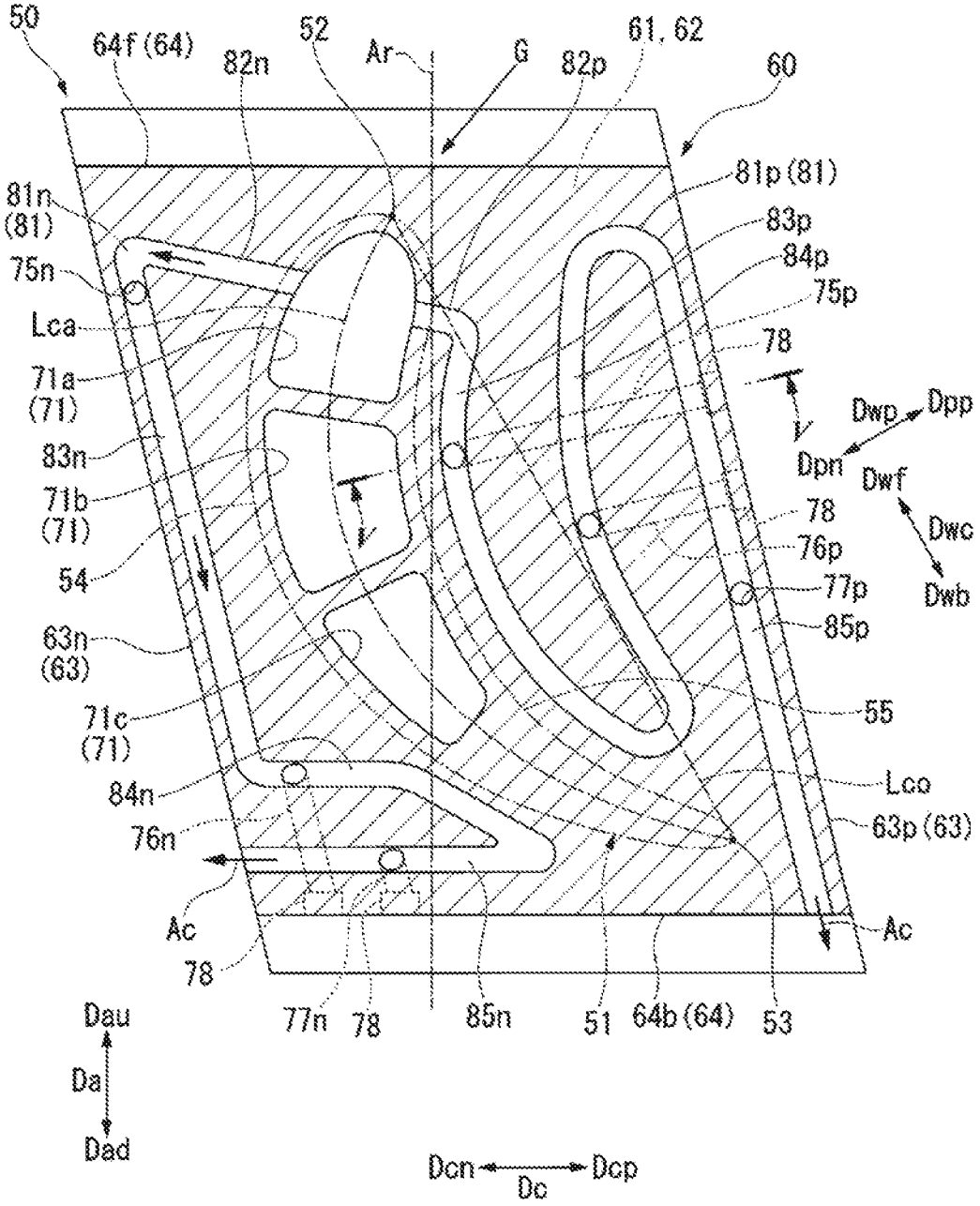
FIG. 4 is a cross-sectional view along a line IV-IV in FIG. 3.

The platform 60 is a plate shaped member that extends from the end portion of the blade height direction Dwh in the blade body 51 in a direction having a perpendicular component with respect to the blade height direction Dwh. In other words, the platform 60 is an end plate of the blade body 51. A gas path surface 61 facing in the combustion gas channel 49 side, a reverse gas path surface 62 with a back matching relationship to the gas path surface 61, and end surfaces 63, 64 along an edge of the gas path surface 61 are formed in the platform 60. As illustrated in FIG. 4, the end surfaces 63, 64 include a pair of side end surfaces 63 that face mutually opposing sides in the width direction Dwp that has a perpendicular component to the blade height direction Dwh and the blade chord direction Dwc, and a pair of front and back end surfaces 64 facing mutually opposing sides in the blade chord direction Dwc. Note that the blade chord direction Dwc is a direction parallel to the blade chord Leo. In a condition where the rotating blade 50 is attached to the rotor shaft 42, the direction that includes a component of the axial direction Da is the blade chord direction Dwc, and the direction that includes a component of the circumferential direction Dc is the width direction Dwp. Furthermore, as described below, the side where the leading edge 52 with respect to the trailing edge 53 of the blade body 51 in the blade chord direction Dwc is the front side Dwf, and the side opposite to the front side Dwf is the back side Dwb. Furthermore, as described below, the side where the back side surface 54 exists with respect to the front side surface 55 of the blade body 51 in the width direction Dwp is the back side Dpn, and the opposite side of the back side Dpn is simply the front side Dpp. Furthermore, as illustrated in FIG. 2, the side where the gas path surface 61 exists with respect to the reverse gas path surface 62 in the blade height direction Dwh is the gas path side Dwhp, and the opposite side is the reverse gas path side Dwha.

The gas path surface 61 of the platform 60 is a surface that extends in a direction having a perpendicular component with respect to the blade height direction Dwh. The pair of side end surfaces 63 both extend in the direction having a perpendicular component to the width direction Dwp, and connect to the gas path surface 61. Furthermore, the pair of front and back end surfaces 64 both extend in the direction having a perpendicular component to the blade chord direction Dwc, and connect to the gas path surface 61. Of the pair of side end surfaces 63, a first side end surface 63 forms a back side end surface 63*n*, and the second side end surface 63 forms a front side end surface 63*p*. The back side end surface 63*n* exists on the back side Dpn with respect to the front side end surface 63*p*. Furthermore, of the pair of front and back end surfaces 64, one of the front and back end surfaces 64 forms the front end surface 64*f*, and the other front and back end surface 64 forms the back end surface 64*b*. The front end surface 64*f* exists on the front side Dcf with respect to the back end surface 64*b*. The back side end surface 63*n* and the front side end surface 63*p* are parallel. Furthermore, the front end surface 64*f* and the back end surface 64*b* are parallel. Therefore, as illustrated in FIG. 4, the platform 60 forms a parallelogram as seen from the blade height direction Dwh. With the rotating blade 50 attached to the rotor shaft 42, the front end surface 64*f* and the back end surface 64*b* are surfaces perpendicular to the axial direction Da. Furthermore, in this condition, the front end surface 64*f* is located on the upstream side Dau in the axial direction Da with respect to the back end side 64*b*.

As illustrated in FIG. 2, the shaft attachment part 90 has a shank 91 that extends from the platform 60 in the opposite side as the blade body 51 in the blade height direction Dwh, or in other words, to the reverse gas path side Dwh, and a blade base 92 extending from the shank 91 on the reverse gas path side Dwh. The blade base 92 has a shape of the cross-section perpendicular to the blade chord with a Christmas tree shape. The blade base 92 is inserted into a blade base groove (not illustrated in the drawings) in the rotor shaft 42 (refer to FIG. 1).

Figure 3:
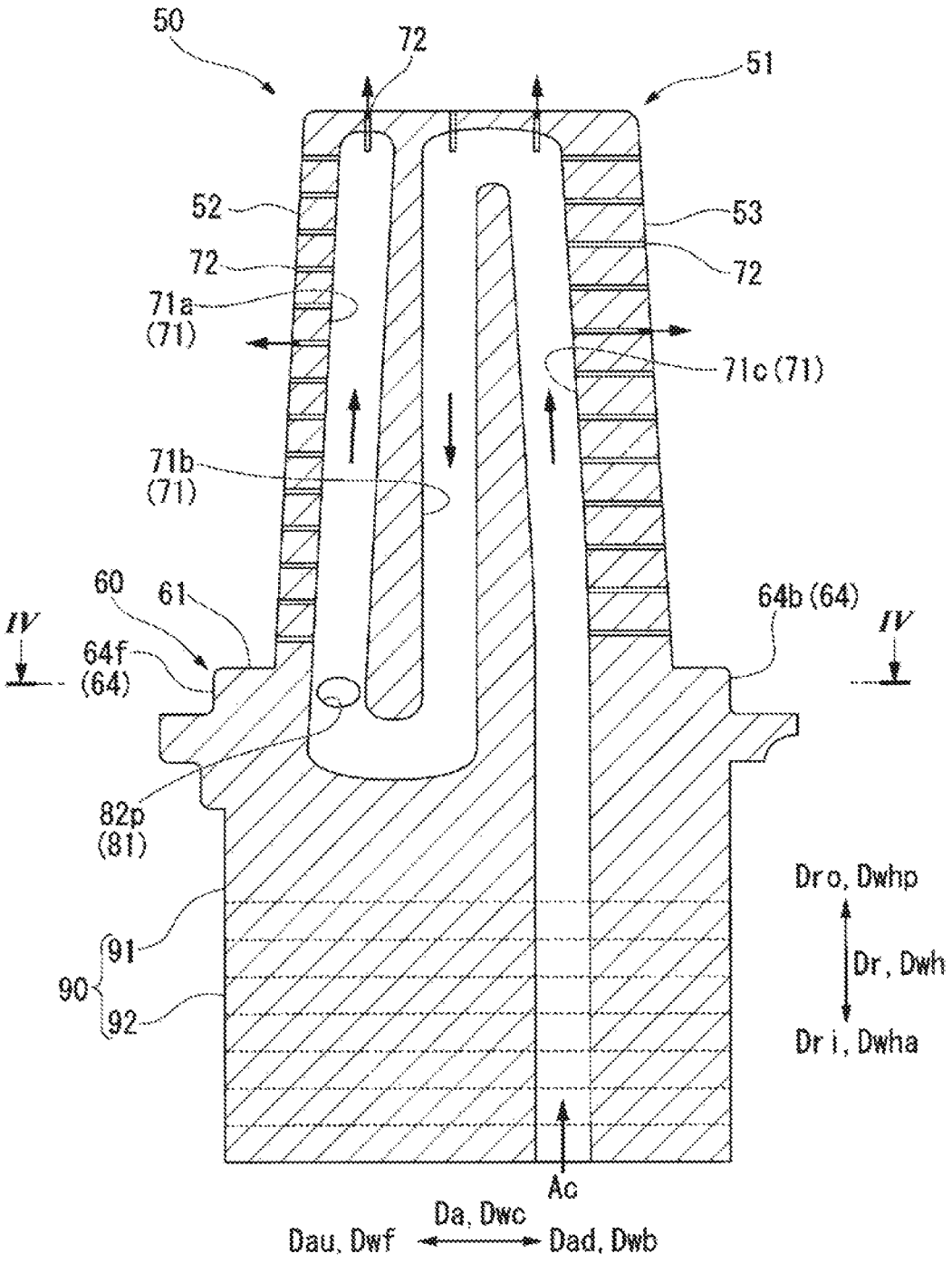
FIG. 3 is a cross-sectional view illustrating the cross-section at a plane along the camber line of the rotating blade according to the first embodiment of the present invention.

As illustrated in FIGS. 2 to 4, a plurality of blade channels 71 that extend in the blade height direction Dwh are formed in the rotating blade 50. All of the blade channels 71 are formed continuous to the blade body 51, platform 60, and shaft attachment part 90. The plurality of blade channel 71 are aligned along the camber line Lca (refer to FIG. 4) of the blade body 51. Adjacent blade channels 71 mutually communicate at a portion of the end in the blade height direction Dwh. Furthermore, at least one blade channel 71 of the plurality of blade channels 71 has an opening at an end in the blade height direction Dwh of the blade base 92. Cooling air Ac from the cooling air channel formed in the rotor shaft 42 flows from this opening into the blade channel 71.

The rotating blade 50 of the present embodiment has, for example, three blade channels 71 formed therein. Of these three blade channels 71, the blade channel 71 on the foremost side Dwf is the first blade channel 71*a*, the blade channel 71 adjacent to the first blade channel 71*a* on the back side Dwb is the second blade channel 71*b*, and the blade channel 71 that is adjacent to the second blade channel 71*b* on the back side Dwb is the third blade channel 71*c*. The third blade channel 71*c* is opened at the end of the reverse gas path side Dha in the blade height direction Dwh of the blade base 92. The second blade channel 71*b* and the third blade channel 71*c* communicate at a portion on the gas path side Dwhp in the blade height direction Dwh. Furthermore, the second blade channel 71*b* and the first blade channel 71*a* communicate at a portion on the reverse gas path side Dwha in the blade height direction Dwh. A plurality of blades surface discharge channels 72 that open to the outer surface of the blade body 51 are formed in the blade channel 71. For example, a plurality of blade surface discharge channels 72 that extend from the third blade channel 71*c* to the back side Dwb and that open to the outer surface of the blade body 51 are formed in the third blade channel 71*c*. Furthermore, a plurality of blade surface discharge channels 72 that extend from the first blade channel 71*a* to the front side Dwf and that open to the outer surface of the blade body 51 are formed in the first blade channel 71*a*.

The blade body 51 is convection cooled by a process where the cooling air Ac flows through the blade channel 71. Furthermore, the cooling air Ac that flows into the blade channel 71 flows into the blade surface discharge channel 72 and flows out from the blade surface discharge channel 72 into the combustion gas channel 49. Therefore, the leading edge 52 and the trailing edge 53 and the like of the blade body 51 are cooled by a process where the cooling air Ac flows through the blade surface discharge channel 72. Furthermore, a portion of the cooling air Ac that flows from the blade surface discharge channel 72 into the combustion gas channel 49 plays a role of partially covering the surface of the blade body 51 as film air.

A platform channel 81 that extends in the platform 60 in the direction along the gas path surface 61 is formed in the platform 60. As illustrated in FIG. 4, the platform channel 81 includes a back side platform channel 81*n* formed in the back side Dpn based on the blade body 51 and a front side platform channel 81*p* formed in the front side Dpp based on the blade body 51.

The back side platform channel 81*n* has an intake channel 82*n*, a side end channel 83*n*, a serpentine first channel 84*n*, and a serpentine second channel 85*n*.

The intake channel 82*n* extends from the inner surface of the back side Dpn of the inner surface of the first blade channel 71*a* to a position of the back side end surface 63*n* on the back side Dpn. The side end channel 83*n* extends from the end of the back side Dpn of the intake channel 82*n* to the back side Dwb along the back side end surface 63*n*. The serpentine first channel 84*n* extends from the end on the back side Dwb of the side end channel 83*n* to the front side Dpp. The serpentine second channel 85*n* extends from the end of the front side Dpp of the serpentine first channel 84*n* to the back side Dpn. The serpentine second channel 85*n* opens on the back side end surface 63*n* of the platform 60. The serpentine first channel 84*n* and the serpentine second channel 85*n* both extend in the direction along the back end surface 64*b*. The serpentine first channel 84*n* and the serpentine second channel 85*n* both extend in the direction along the back end surface 64*b*. Note that in the present application, the phrase "two channels are aligned in the perspective direction with respect to the end surface" indicates that the distance from the end surfaces of the two channels are mutually different and a portion of the two channels are overlapping as seen from the perspective direction with respect to the end surface. The serpentine second channel 85*n* is located on the side closer to the back end surface 64*b* than the serpentine first channel 84*n*, and forms the outside channel. Furthermore, the serpentine first channel 84*n* is located on the side closer to the back end surface 64*b* than the serpentine second channel 85*n*, and forms the inside channel. The serpentine first channel 84*n* and the serpentine second channel 85*n* mutually communicate at the front side Dpp. Therefore, one serpentine channel that zigzags in a direction along the back end surface 64*b* is formed by the serpentine first channel 84*n* and the serpentine second channel 85*n*. Note, the back end surface 64*b* of the platform that is the end plate forms a partial end surface with respect to the serpentine first channel 84*n* and the serpentine second channel 85*n*.

The front side platform channel 81*p* has an intake channel 82*p*, a serpentine first channel 83*p*, a serpentine second channel 84*p*, and a serpentine third channel 85*p*.

The intake channel 82*p* extends from the inner surface on the front side Dpp of the inner surface of the first blade channel 71*a* to the front side Dpp. The serpentine first channel 83*p* extends from the end of the front side Dpp of the intake channel 82*p* toward the back side Dwb. The serpentine second channel 84*p* extends from the end of the back side Dwb of the serpentine first channel 83*p* to the front side Dwf. The serpentine third channel 85*p* extends from the end of the front side Dwf of the serpentine second channel 84*p* to the back side Dwb. The serpentine third channel 85*p* opens on the back end surface 64*b* of the platform. The serpentine first channel 83*p*, the serpentine second channel 84*p*, and the serpentine third channel 85*p* all extend in the direction along the front side end surface 63*p*. The serpentine first channel 83*p*, the serpentine second channel 84*p*, and the serpentine third channel 85*p* are aligned in the perspective direction with respect to the front side end surface 63*p*. The serpentine third channel 85*p* is located on the side closer to the front side end surface 63*p* than the serpentine first channel 83*p* and the second serpentine channel, and forms the outside channel. Furthermore, the serpentine second channel 84*p* is located closer to the far side with respect to the front side end surface 63*p* than the serpentine third channel 85*p*, and forms the inside channel. The serpentine first channel 83*p* is located closer to the far side with respect to the front side end surface 63*p* than the serpentine second channel 84*p*, and forms the inside channel. The serpentine first channel 83*p* and the serpentine second channel 84*p* mutually communicate on the back side Dwb. Furthermore, the serpentine second channel 84*p* and the serpentine third channel 85*p* mutually communicate on each of the front side Dwf ends. Therefore, one serpentine channel that zigzags in a direction along the front side end surface 63*b* is formed by the serpentine first channel 83*p*, the serpentine second channel 84*p*, and the serpentine third channel 85*p*, Note, the front side end surface 63*p* of the platform 60 that is the end plate forms a partial end surface with respect to the serpentine first channel 83*p*, the serpentine second channel 84*p*, and the serpentine third channel 85*p*.

Furthermore, a side end skirt hole 75*n*, hack side first skirt hole 76*n*, hack side second skirt hole 77*n*, front side first skirt hole 75*p*, front side second skirt hole 76*p*, and front side third skirt hole 77*p* are formed in the platform 60, The side end skirt hole 75*n* communicates with the side end channel 83*n* in the platform channel 81. The side end skirt hole 75*n* extends from the side end channel 83*n* to the reverse gas path side Dwha, and opens at the reverse gas path surface 62 of the platform 60. The back side first skirt hole 76*n* communicates with the serpentine first channel 84*n* in the back side platform channel 81*n*. The back side first skirt hole 76*n* extends from the serpentine first channel 84*n* to the back side Dwb, and opens on the back end surface 64*b* of the platform 60. The back side second skirt hole 77*n* communicates with the serpentine second channel 85*n* in the back side platform channel 81*n*. The back side second skirt hole 77*n* extends from the serpentine second channel 85*n* to the back side Dwb, and opens on the back end surface 64*b* of the platform 60. The front side first skirt hole 75*p* communicates with the serpentine first channel 83*p* in the front side platform channel 81*p*. The front side first skirt hole 75*p* extends from the serpentine first channel 83*p* to the front side Dpp, and opens on the front side end surface 63*p* of the platform 60. The front side second skirt hole 76*p* communicates with the serpentine second channel 84*p* in the front side platform channel 81*p*. The front side second skirt hole 76*p* extends from the serpentine second channel 84*p* to the front side Dpp, and opens on the front side end surface 63*p* of the platform 60. The front side third skirt hole 77*p* communicates with the serpentine third channel 85*p* in the front side platform channel 81*p*. The front side third skirt hole 77*p* extends from the serpentine third channel 85*p* to the reverse gas path side Dwha, and opens at the reverse gas path surface 62 of the platform 60. The openings of the skirt holes in the platform 60 are blocked by plugs 78.

Note that the side end skirt hole 75*n* opens at the reverse gas path surface 62 of the platform 60. The side end skirt hole 75*n* extends from the side end channel 83*n* to the back side Dpn, and opens at the back side end surface 63*n* of the platform 60. Furthermore, herein, the front side third skirt hole 77*p* opens at the reverse gas path surface 62 of the platform 60. However, the front side third skirt hole 77*p* extends from the serpentine third channel 85*p* in the front side platform channel 81*p* to the front side Dpp, and opens on the front side end surface 63*p* of the platform 60.

Figure 5:
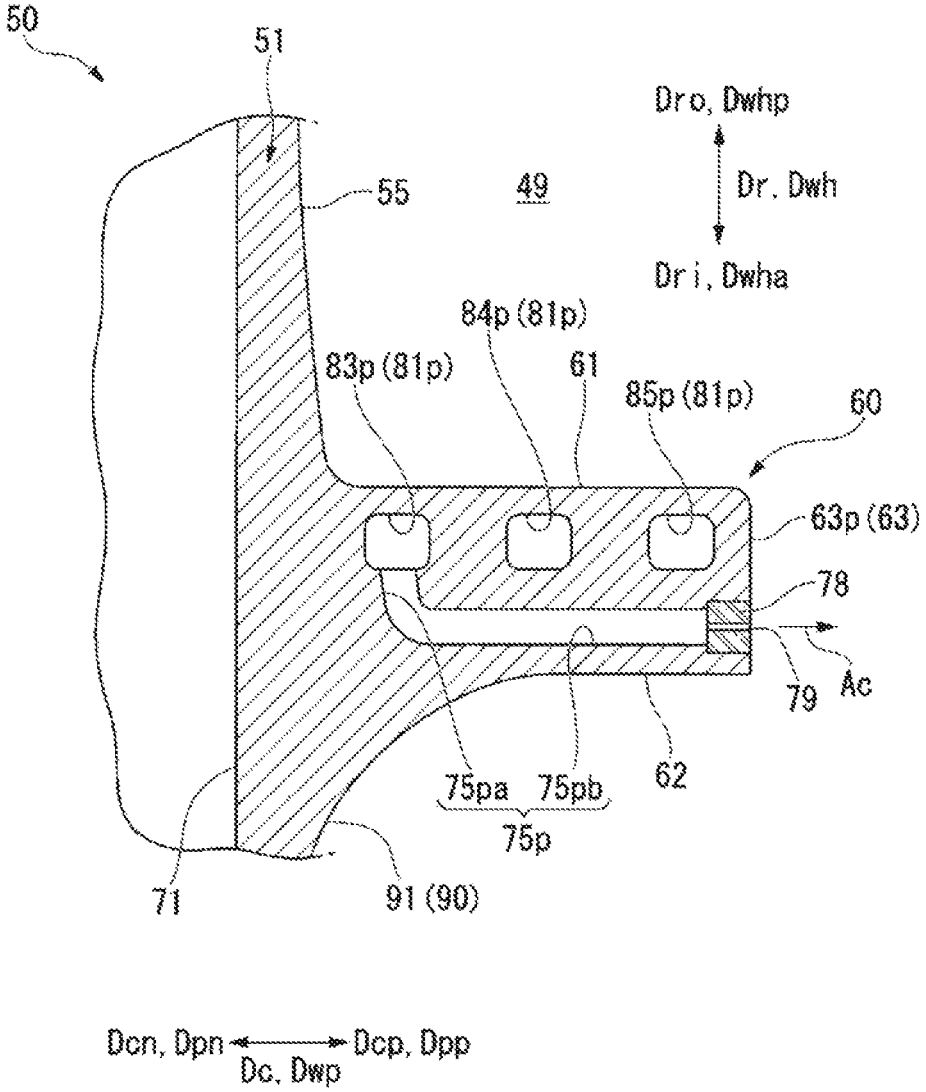
FIG. 5 is a cross-sectional view along line V-v of FIG. 4.

As illustrated in FIG. 5, the front side first skirt hole 75*p* includes a first extending part 75*pa* that extends from the serpentine first channel 83*p* in the front side platform channel 81*p* to the reverse gas path side Dwha, and a second extending part 75*pb* that extends from the end portion of the reverse gas path side Dwha in the first extending part 75*pa* to the front side Dpp and opens at the front side end surface 63*p*. The second extending part 75*pb* passes through the reverse gas path side Dwha with respect to the serpentine second channel 84*p* and the serpentine third channel 85*p* in the front side platform channel 81*p*. Therefore, as seen from the blade height direction Dwh, as illustrated in FIG. 4, with the second extending part 75*pb* of the front side first skirt hole 75*p*, the serpentine second channel 84*p* and the serpentine third channel 85*p* partially overlap in the front side platform channel 81*p*. In other words, as seen from the blade height direction Dwh, the second extending part 75*pb* of the front side first skirt hole 75*p* intersects with the serpentine second channel 84*p* and the serpentine third channel 85*p* in the front side platform channel 81*p*. The opening of the back side end surface 63*n* in the second extending part 75*pb* is blocked by a plug 78, as described above. The plug 78 is joined by welding or the like to the platform 60. A through hole 79 that discharges cooling air from the front side first skirt hole 75*p* to the outside is formed in the plug 78.

Although not illustrated in the drawings, similar to the front side first skirt hole 75*p*, the front side second skirt hole 76*p* includes a first extending part that extends from the serpentine second channel 84*p* in the front side platform channel 81*p* to the reverse gas path side Dwha, and a second extending part that extends from the end portion of the reverse gas path side Dwha in the first extending part to the front side Dpp and opens at the front side end surface 63*p*. Similar to the second extending part 75*pb* of the front side first skirt hole 75*p*, this second extending part also passes through the reverse gas path side Dwha with respect to the serpentine third channel 85*p* in the front side platform channel 81*p*. Therefore, as seen from the blade height direction Dwh, as illustrated in FIG. 4, the second extending part 75*pb* of the front side second skirt hole 76*p* appears to intersect with the serpentine third channel 85*p* in the front side platform channel 81*p*.

Although not illustrated in the drawings, the hack side first skirt hole 76*n* includes a first extending part that extends from the serpentine first channel 84*n* in the hack side platform channel 81*n* to the reverse gas path side Dwha, and a second extending part that extends from the end portion of the reverse gas path side Dwha in the first extending part to the back side Dwb and opens at the hack end surface 64*b*. The second extending part passes through the reverse gas path side Dwha with respect to the serpentine second channel 85*n* in the back side platform channel 81*n*. Therefore, as seen from the blade height direction Dwh, as illustrated in FIG. 4, the second extending part of the back side first skirt hole 76*n* appears to intersect with the serpentine second channel 85*n* in the back side platform channel 81*n*.

Figure 6:
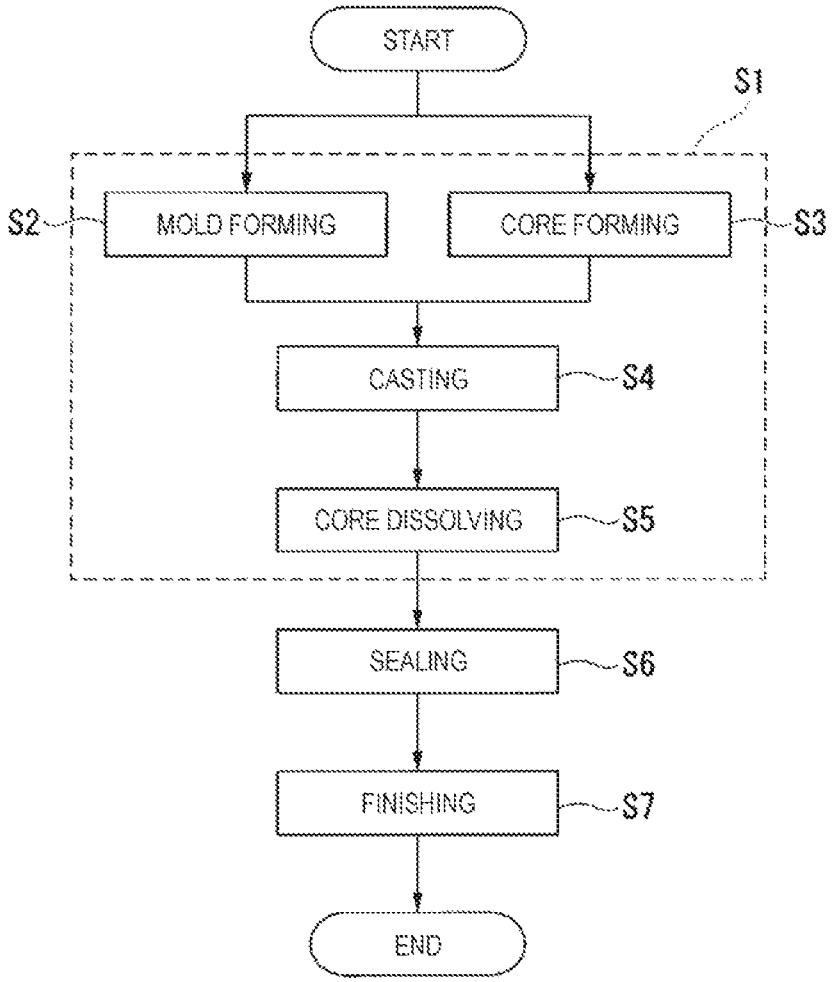
FIG. 6 is a flow chart illustrating a manufacturing method for a rotating blade according to the first embodiment of the present invention.

Next, the manufacturing method of the rotating blade 50 described above is described by the following the flowchart shown in FIG. 6.

First, an intermediate product of the rotating blade 50 is formed by casting (S1: intermediate product forming step). In the intermediate product forming step (S1), a mold forming step (S2), core forming step (S3), casting step (S4), and core dissolving step (S5) are performed.

In the mold forming step (S2), a mold is formed with an internal space that matches the external shape of the rotating blade 50. In the mold forming step (S2), the mold is formed by a lost wax method, for example. In the lost wax method, first a wax model that reproduces the outer shape of the rotating blade 50 is formed. Next, the wax model is placed in a slurry containing refractory powder or the like, and then the slurry is dried. Furthermore, the wax model is removed from the slurry after drying to form a mold.

In the core forming step (S3), the blade channel core with an outer shape that matches the shape of the blade channel 71, a platform channel core with an outer shape that matches the shape of the platform channel 81, and a skirt core with an outer shape that matches the shape of the skirt holes are formed. The platform channel core includes a front side platform channel core with an outer shape that matches the shape of the front side platform channel 81*p* and a back side platform channel core with an outer shade that matches the back side platform channel 81*n*.

The skirt core includes a side end skirt core with an outer shape that matches the shape of the side end skirt hole 75*n*, a back side first skirt core that matches the shape of the back side first skirt hole 76*n*, and a back side second skirt core with an outer shape that matches the shape of the back side second skirt hole 77*n*. These skirt cores are integrally formed with the back side platform channel core. Furthermore, the skirt core includes a front side first skirt core with an outer shape that matches the shape of the front side first skirt hole 75*p*, a front side second skirt core with an outer shape that matches the shape of the front side second skirt hole 76*p*, and a front side third skirt core with an outer shape that matches the shape of the front side third skirt hole 77*p*.

These skirt cores are integrally formed with the front side platform channel core. The cores are all formed of a ceramic such as alumina, and the like. The core forming step (S3) can be performed in parallel with the mold forming step (S2), and can be performed before or after the mold forming step (S2).

Figure 7:
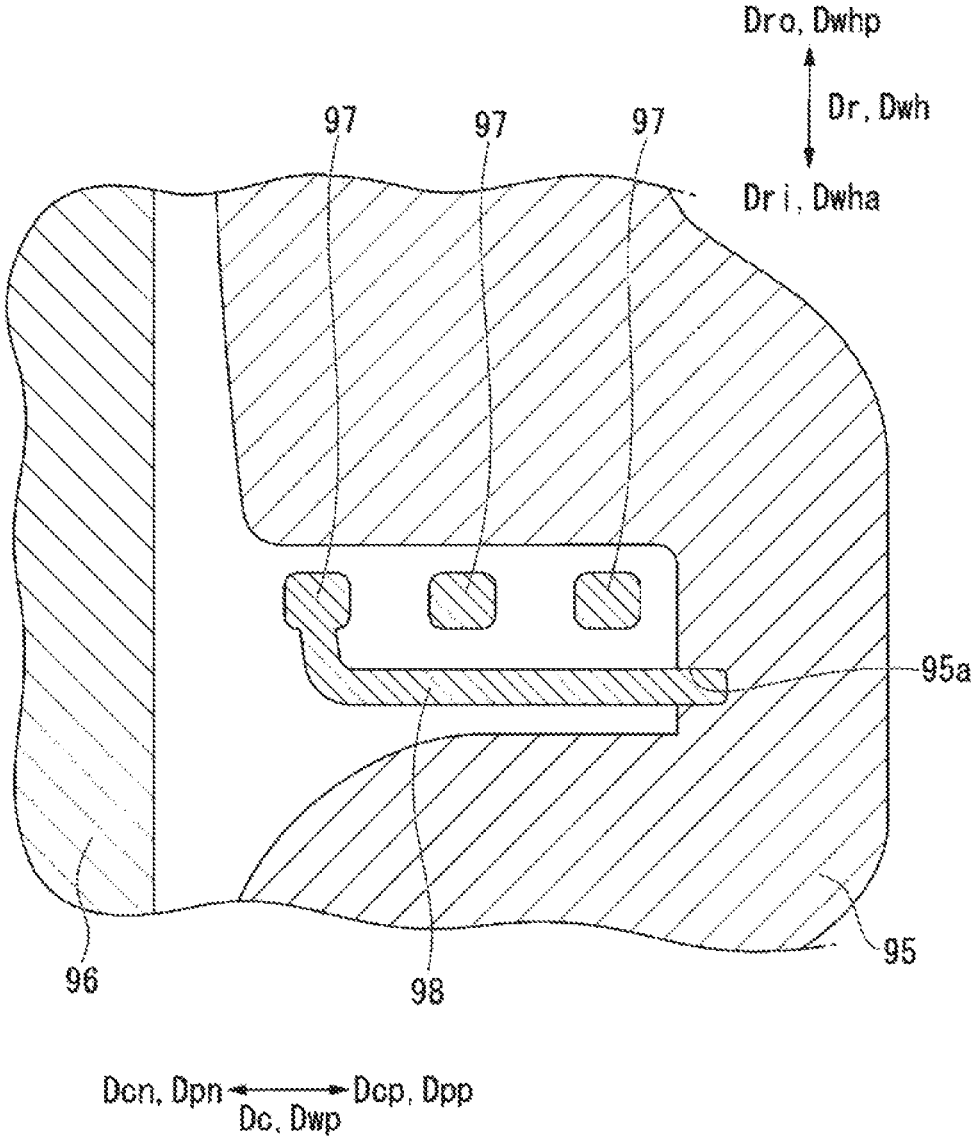
FIG. 7 is a cross-sectional view illustrating the main parts of the mold and the core formed in the rotating blade manufacturing process of the first embodiment of the present invention.

In the casting step (S4), as illustrated in FIG. 7, the blade channel core 96, platform channel core 97, and skirt core 98 are placed in the mold 95, and molten metal is injected into the mold 95.

The molten metal is a melted material of a nickel based alloy or the like with high heat resistance, for example. A core holding hole 95*a* where the end portion of the skirt core 98 is inserted is formed in the mold 95, with a recess on the outer surface side from the inner surface. The end portion of the skirt core 98 is inserted into the core holding hole 95*a*. Therefore, the skirt core 98 is held in the mold 95. The platform channel core 97 is integrated with the skirt core 98 as described above. Therefore, the platform channel core 97 is held in the mold 95 through the skirt core 98. In other words, the skirt core 98 determines the position of the platform channel core 97 in the mold 95, and plays a role in holding this position.

The core dissolving step (S5) is performed after the molten metal that was injected into the mold 95 hardens. In the core dissolving step (S5), the ceramic cores are dissolved by an alkaline aqueous solution. At this time, the skirt holes formed by each of the skirt cores guide the alkaline aqueous solution to the platform channel formed by the platform channel core, and also play a role in discharging the alkaline aqueous solution to the outside.

This completes the intermediate product forming step (S1), and an intermediate product of the rotating blade 50 is achieved.

Next, the openings of the core holes in the end surface of the platform 60 are blocked by plugs 78 (S6: sealing step). In the sealing step (S6), a lower hole is formed by a mechanical process or the like in an attachment portion for the plug 78 in the platform 60, and a plug 78 is inserted into the lower hole. Furthermore, the plug 78 is joined by welding or the like to the platform 60. Note that the inner diameter of the lower hole is normally formed to be larger than the inner diameter of the core hole.

Note that if the blade channel 71 and the platform channel 81 that are formed in the intermediate product are not communicating by a communication hole that allows communication between the blade channel 71 and the platform channel 81 is formed by an electrolytic process or an electric discharge process or the like before or after the sealing step (S6).

Next, a finishing staff is performed on the intermediate product that has completed the sealing step (S6) to complete the rotating blade 50 (S7: finishing step). During the finishing step (S7), the outer surface of the intermediate product is polished. Furthermore, if necessary, a heat resistant coating is applied to the outer surface of the intermediate product.

Next, the effect of the rotating blade 50 of the present embodiment will be described. First, a rotating blade 50*z* of a comparative example is described.

Figure 8:
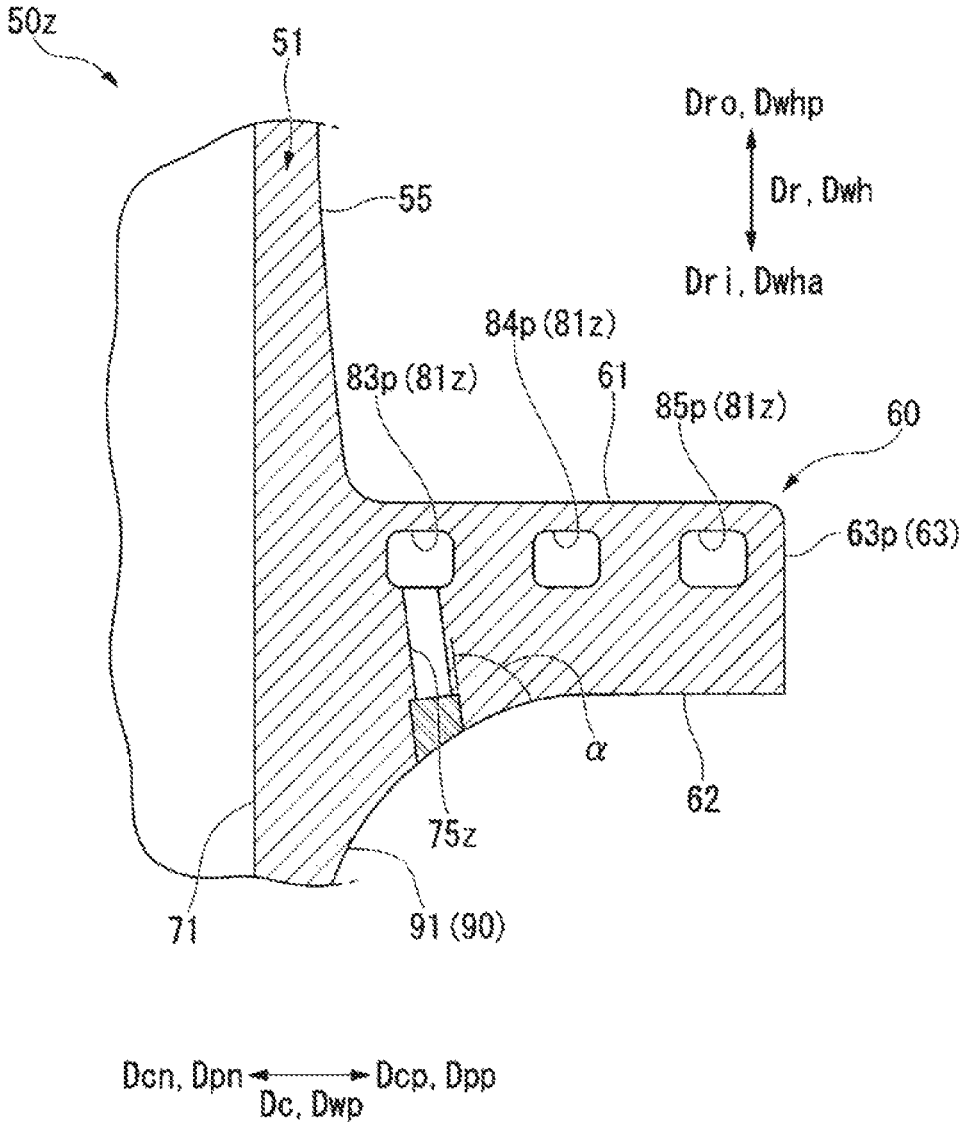
FIG. 8 is a cross-sectional view of main parts illustrating the cross-section of a plane that extends in the blade thickness direction of the rotating blade according to a comparative example.

As illustrated in FIG. 8, the rotating blade 50*z* of the comparative example also has a blade body 51, platform 60, and shaft attachment part 90. Blade channels 71 where cooling air flows, with an interior that extends in the blade height direction Dwh are formed in the blade body 51, platform 60, and shaft attachment part 90. A gas path surface 61 facing in the blade height direction Dwh and that contacts the combustion gas, and a reverse gas path surface 62 with a back matching relationship to the gas path surface 61, are formed in the platform 60. Furthermore, a platform channel 81*z* that extends in the direction along the gas path surface 61 and a skirt hole 75*z* are formed in the platform 60. The platform channel 81*z* in the comparative example is configured similar to the front side platform channel 81*p* of the present embodiment illustrated in FIG. 4 and FIG. 5. In other words, the platform channel 81*z* of the comparative example has a serpentine first channel 83*p*, a serpentine second channel 84*p*, and a serpentine third channel 85*p* that extend in the direction along the front side end surface 63*p*. One serpentine channel that zigzags in a direction along the front side end surface 63*b* is formed by the serpentine first channel 83*p*, the serpentine second channel 84*p*, and the serpentine third channel 85*p*.

Similar to the serpentine first channel 83*p* of the present embodiment illustrated in FIG. 5, a skirt hole 75*z* communicates with the serpentine first channel 83*p* which is the inside channel. However, the skirt hole 75*z* extends linearly from the serpentine first channel 83*p* to the reverse gas path side Dwha, and opens near the border between the platform 60 and the shaft attachment part 90.

The tip end of the blade body 51 of the moving blade 50 is a free end, and the blade body 51 is subjected to centrifugal force as well as force from the combustion gas. On the other hand, the shaft attachment part 90 of the rotating blade 50 is attached to the rotor shaft 42 (refer to FIG. 1). Therefore, a high stress is generated near the border between the shaft attachment part 90 and the platform 60. Therefore, with many rotating blades 50, a shank 91 of the shaft attachment part 90 is made to be gradually thicker in the width direction Dwp when approaching the platform 60 in order to relieve the stress generated near the border between the shaft attachment part 90 and the platform 60. Therefore, the surface of the shank 91 on the front side Dpp forms a gradual smooth curved surface moving towards the front side Dpp of the platform 60 when approaching the reverse gas path surface 62 of the platform 60. However, a higher stress is generated near the border between the shaft attachment part 90 and the platform 60 as compared to the end or the like on the front side Dpp of the platform 60, for example. Therefore, if an opening for the skirt hole 75*z* is formed in this portion, stress will occur in this portion.

Furthermore, the stress is easily concentrated near the opening. In addition, if an opening for the skirt hole 75*z* is formed in the curved surface, a portion is formed where the angle $\alpha$ formed between this curved surface and the inner circumferential surface of the skirt hole 75*z* is an acute angle, and even higher stress will occur in this portion.

Therefore, with the rotating blade 50*z* of the comparative example, the region proximal to the opening of the skirt hole 75*z* is easily damaged.

On the other hand, with the present embodiment, as illustrated in FIG. 5, the front side first skirt hole 75*p* that communicates with the serpentine first channel 83*p* which is the inside channel opens at the front side end surface 63*p* of the platform 60. Therefore, with the present embodiment, stress occurs in the portion where the front side first skirt hole 75*p* opening is formed. However, the outer circumferential side portion of the platform 60 is essentially a free end, so the stress caused by centrifugal force and the gas force that occurs in the side end including the front side end surface 63*p* of the platform 60 will be extremely small. Furthermore, the angle formed between the front side end surface 63*p* and the inner surface of the front side first skirt hole 75*p* is an acute angle of approximately 90°, and a high stress does not occur around the opening of the front side first skirt hole 75*p*. Therefore, with the present embodiment, this blade can suppress damage near the opening of the front side first skirt hole 75*p*.

Furthermore, with the present embodiment, the cooling air that flows through the serpentine first channel 83*p* passes through the front side first skirt hole 75*p* and the through hole 79 of the plug 78, and is discharged from the front side end surface 63*p* of the platform 60. In other words, with the present embodiment, the front side first skirt hole 75*p* is used as an air channel through which the cooling air Ac passes. The cooling air Ac discharged from the front side end surface 63*p* of the platform 60 cools the front side end surface 63*p* and also cools the back side end surface 63*n* of the other vanes that are adjacent to the front side Dpp of the vanes. Therefore, with the present embodiment, the front side end surface 63*p* of the platform 60 cooled more than with the comparative example. Furthermore, with the present embodiment, the flow of cooling air Ac discharged from the front side end surface 63*p* can be appropriately adjusted by appropriately adjusting the inner diameter of the through hole 79 of the plug 78. Therefore, with this embodiment, the amount of cooling air that is used can be controlled while appropriately cooling the front side end surface 63*p*.

Furthermore, similar to the front side first skirt hole 75*p*, the front side second skirt hole 76*p* of the present embodiment opens at the front side end surface 63*p* of the platform 60. Therefore, damage near the opening of the front side second skirt hole 76*p* can be suppressed, and the front side end surface 63*p* of the platform 60 can be cooled. Furthermore, the back side first skirt hole 76*n* of the present embodiment opens at the back end surface 64*b* of the platform 60. Therefore, damage near the opening of the back side first skirt hole 76*n* can be suppressed, and the back end surface 64*b* of the platform 60 can be cooled.

As described above, with the present embodiment, the damage to the rotating blade 50 can be suppressed in conjunction with formation of the skirt holes. Furthermore, with the present embodiment, a portion of the end surface of the platform 60 can be cooled.

Note that with the present embodiment, the back side platform channel 81*n* has a serpentine channel. However, the back side platform channel 81*n* does not necessity form a serpentine channel. Furthermore, with the present embodiment, the back side Dwb portion of the back side platform channel 81*n* forms a serpentine channel. However, it is also acceptable for the front side Dwf portion of the back side platform channel 81*n* as well, or for only the front side Dwf portion of the back side platform channel 81*n* to form a serpentine channel. The serpentine channel of the back side platform channel 81*n* may zigzag in a direction along the back side end surface 63*n* and the front end surface 64*f* of the platform 60. In this case, the sheet hole that communicates with the inside channel which is a portion of the serpentine channel is open at the back side end surface 63*n* or the front end surface 64*f*. Furthermore, the serpentine channel in the front side platform channel 81*p* of the present embodiment zigzags in a direction along the front side end surface 63*p*. However, the serpentine channel of the front side platform channel 81*p* may zigzag in a direction along the back end surface 64*b* and the front end surface 64*f* of the platform 60. In this case, the sheet hole that communicates with the inside channel which is a portion of the serpentine channel is open at the front end surface 64*f* or the back end surface 64*b*.

First Variation of the Rotating Blade

Figure 9:
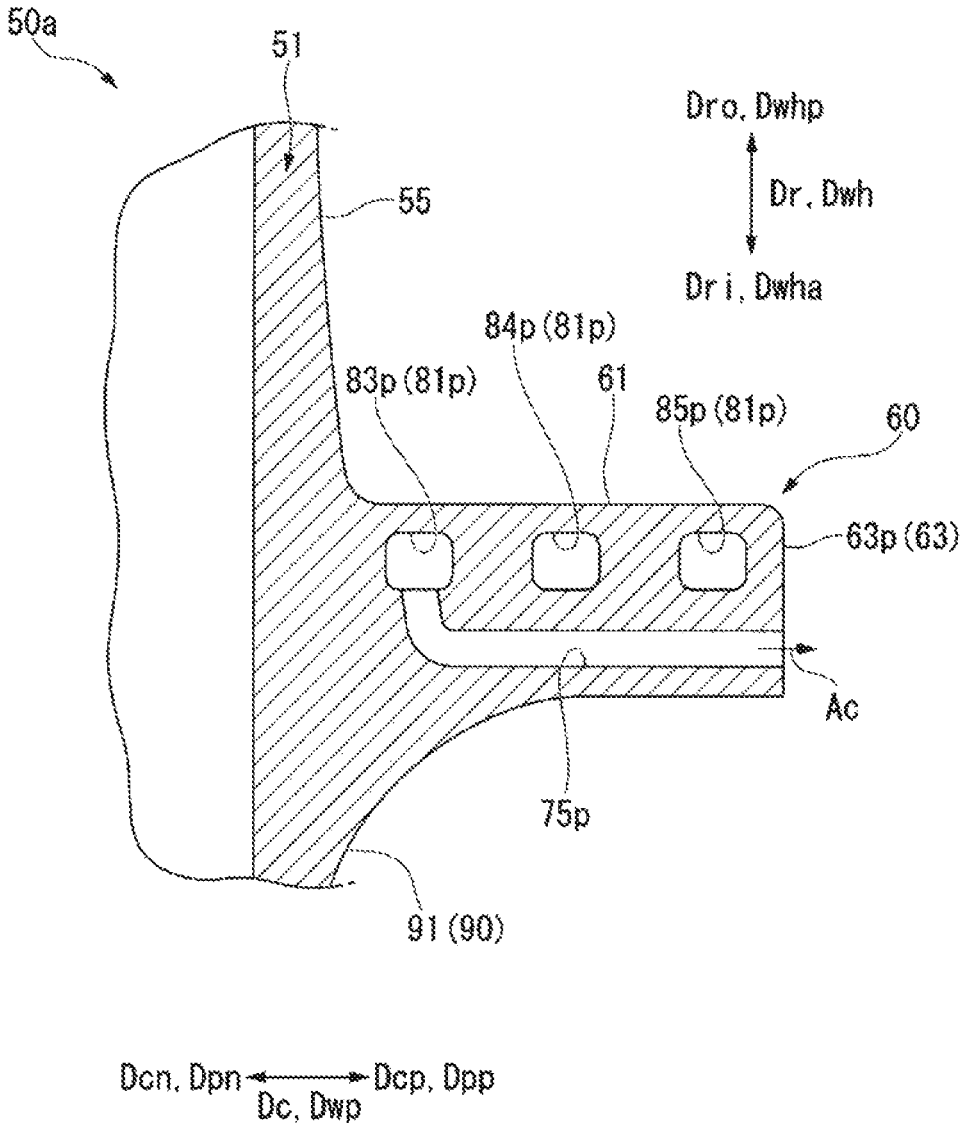
FIG. 9 is a cross-sectional view of main parts illustrating the cross-section of a plane that extends in the blade thickness direction of the rotating blade according to a first variant example according to the present invention.

A first variation of the rotating blade according to the embodiment described above will be described by referring to FIG. 9.

With the rotating blade 50*a* of the present variation, the opening of the sheet hole 75*p* in the partial end surface (front side end surface) 63*p* of the platform 60 is not blocked by a plug 78. Therefore, with the present variation, the partial end surface 63*p* of the platform 60 can be better cooled.

Note that if the partial end surface 63*p* of the platform 60 does not need to be cooled by the cooling air Ac discharged from the partial end surface 63*p*, the opening of the skirt hole 75*p* in the partial end surface 63*p* can be blocked by a plug where a through hole 79 is not formed.

Second Variation of the Rotating Blade

Figure 10:
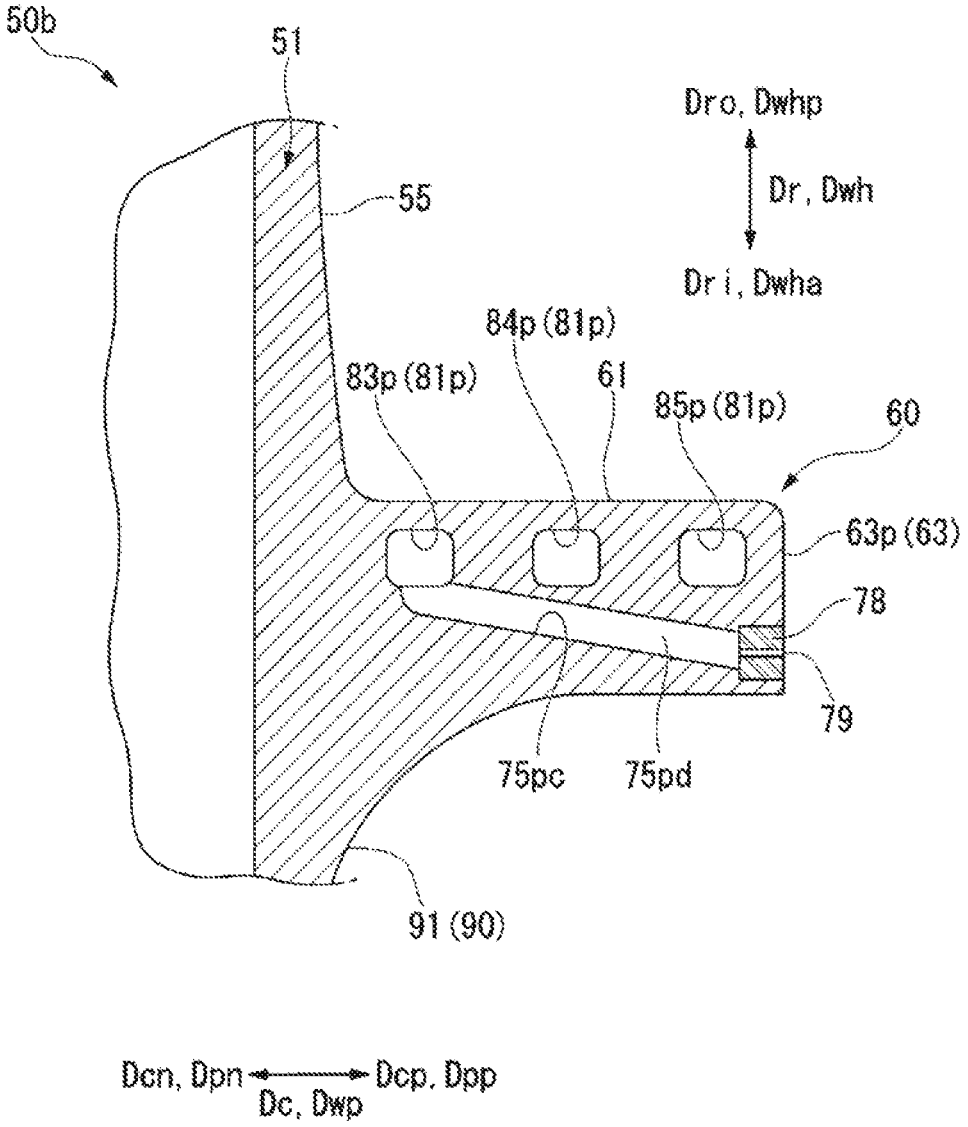
FIG. 10 is a cross-sectional view of main parts illustrating the cross-section of a plane that extends in the blade thickness direction of the rotating blade according to a second variant example according to the present invention.

A second variation of the rotating blade according to the aforementioned embodiment is described while referring to FIG. 10.

As illustrated in FIG. 5, the skirt hole 75*p* of the aforementioned embodiment includes a first extending part 75*pa* that extends from the inside channel 83*p* in the serpentine channel to the reverse gas path side Dwha, and a second extending part 75*pb* that extends from the end portion of the reverse gas path side Dwha in the first extending part 75*pa* to the partial end surface 63*p* of the platform 60, and opens at the partial end surface 63*p*.

The skirt hole 75*pc* in the rotating blade 50*b* of the present variation has an tilted hole part 75*pd* that gradually extends linearly from the inside channel 83*p* in the serpentine channel to the side near the side of the reverse gas path surface 62 when approaching the partial end side 63*p*. The tilted hole part 75*pd* opens at the partial end surface 63*p*.

The air channel formed in the rotating blade may be inspected by inserting a borescope inside.

With this variation, the borescope can easily be inserted into the inside channel 83*p* from the skirt hole 75*pc*. Therefore, with this variation, inspection of the inside channel 83*p* can easily be performed.

Note that with the present variation, similar to the first variation, the opening of the skirt hole 75*pc* in the partial end surface 63*p* is not required to be plugged by the plug. Furthermore, with the present variation, a through hole 79 is not necessarily formed in the plug 78.

Third Variation of the Rotating Blade

Figure 11:
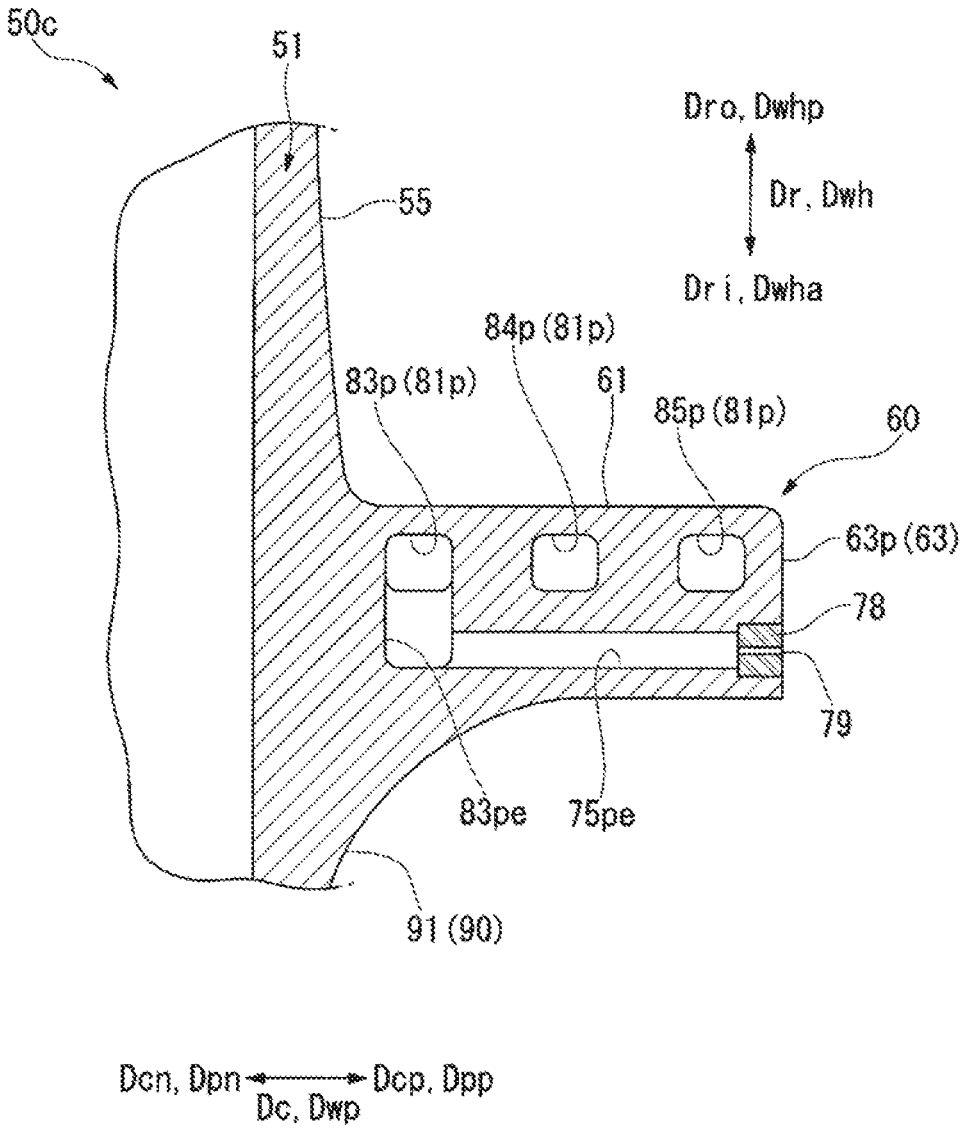
FIG. 11 is a cross-sectional view of main parts illustrating the cross-section of a plane that extends in the blade thickness direction of the rotating blade according to a third variant example of the present invention.

A third variation of the rotating blade according to the embodiment described above will be described while referencing FIG. 11.

Similar to the skirt hole 75*pc* of the second variation, the skirt hole 75*pe* in the rotating blade 50*c* of the present variation is a hole that extends linearly from the inside channel 83*p* in the serpentine channel toward the partial end surface 63*p* of the platform 60. However, unlike the skirt hole 75*pc* of the second variation, the skirt hole 75*pe* of the present variation is a hole that extends linearly from the inside channel 83*p* in the serpentine channel toward the partial end surface 63*p* of the platform 60 essentially parallel to the gas path surface 61.

With the present variation, the skirt hole 75*pe* is essentially parallel to the gas path surface 61, and therefore the inside channel 83*p* in the serpentine channel has an expanded part 83*pe* that is expanded toward the reverse gas path side Dwha. The skirt hole 75*pe* of the present variation is a hole that extends linearly from the inside surface of the partial end surface 63*p* of the inner surface of the expanded part 83*pe* toward the partial end surface 63*p* of the platform 60, essentially parallel to the gas path surface 61.

With this variation, similar to the second variation, a borescope can easily be inserted into the inside channel 83*p* from the skirt hole 75*pe*. Therefore, with this variation, inspection of the inside channel 83*p* can easily be performed.

Note that with the present variation as well, similar to the first variation, the opening of the skirt hole 75*pe* in the partial end surface 63*p* is not required to be plugged by the plug. Furthermore, with the present variation, a through hole 79 is not necessarily formed in the plug 78.

Furthermore, the inside channel 83*p* of the aforementioned embodiment and the aforementioned second variation may have the expanded part 83*pe* of the present variation. If the inside channel 83*p* of the aforementioned embodiment has an expanded portion 83*pe*, the first extended part 75*pc* of the skirt hole 75*p* extends from the expanded part 83*pe* to the reverse gas path side Dwha. If the inside channel 83*p* of the aforementioned second variation has an expanded portion 83*pe*, the tilted hole part 75*pd* of the skirt hole 75*pc* extends from the expanded part 83*pe*.

Fourth Variation of the Rotating Blade

Figure 12:
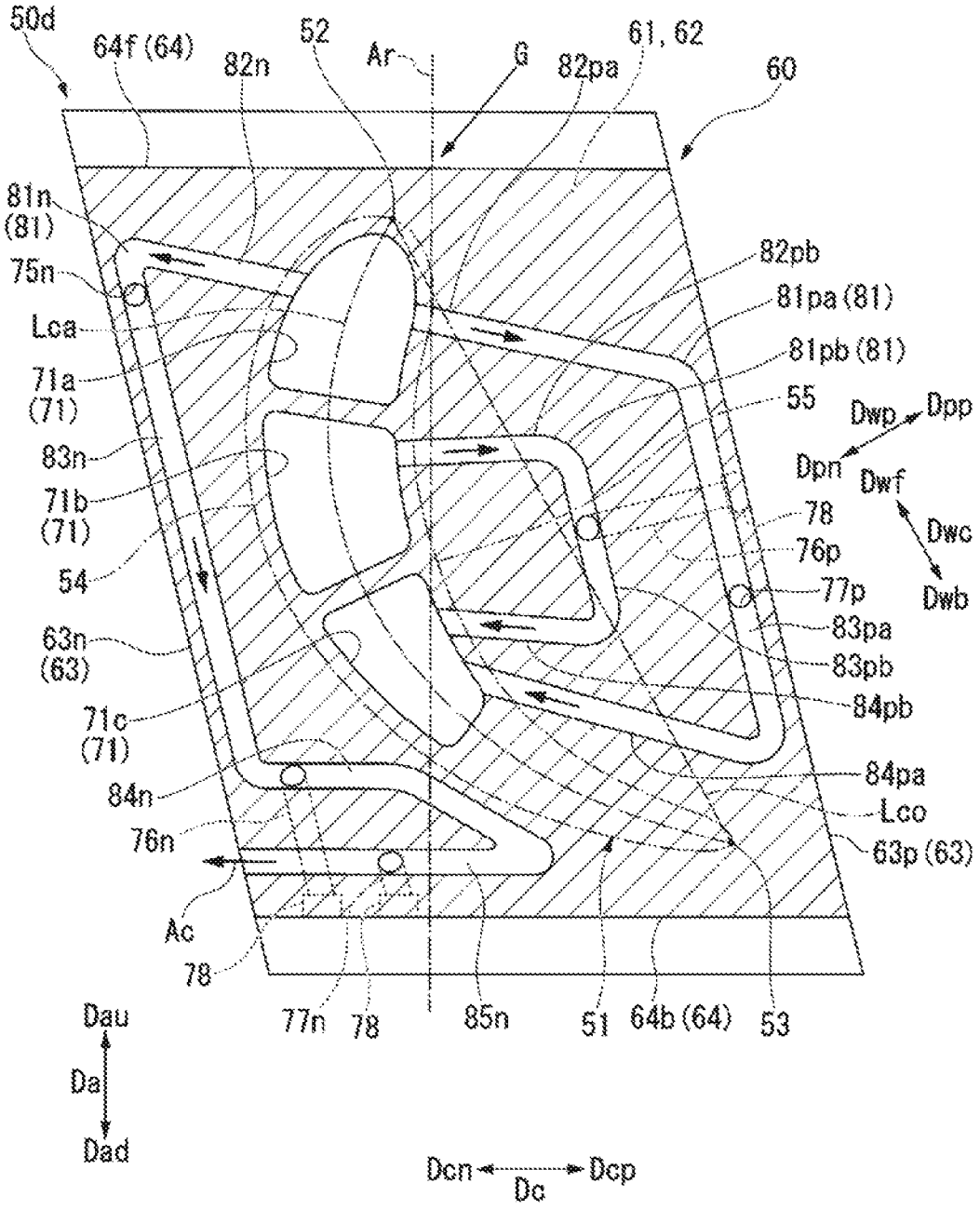
FIG. 12 is a cross-sectional view perpendicular to the blade height direction of the rotating blade according to a fourth variant example of the present invention.

A fourth variation of the rotating blade according to the embodiment described above will be described while referring to FIG. 12.

The platform 60 in the rotating blade 50*d* of the present variation has a first front side platform channel 81*pa* and a second front side platform channel 81*pb* as the front side platform channel. The first front side platform channel 81*pa* has an intake channel 82*pa*, side end channel 83*pa*, and a discharge channel 84*pa*. The second front side platform channel 81*pb* has an intake channel 82*pb*, side end channel 83*pb*, and a discharge channel 84*pb*.

The intake channel 82*pa* of the first front side platform channel 81*pa* extends from the inner surface of the front side Dpp of the inner surface of the first blade channel 71*a* to a position near the front side end surface 63*p* on the front side Dpp. The side end channel 83*pa* of the first front side platform channel 81*pa* extends from the end on the front side Dpp of the intake channel 82*pa* to the back side Dwb along the front side end surface 63*p*. The intake channel 84*pa* of the first front side platform channel 81*pa* extends from the end on the back side Dwb of the side end channel 83*pa* to the back side Dpp, and communicates with the third blade channel 71*c*. The intake channel 82*pb* of the first front side platform channel 81*pb* extends from the inner surface of the front side Dpp of the inner surface of the second blade channel 71*b* to the front side Dpp. The side end channel 83*pb* of the second front side platform channel 81*pb* extends from the end on the front side Dpp of the intake channel 82*pb* to the back side Dwb along the front side end surface 63*p*. The intake channel 84*pb* of the second front side platform channel 81*pb* extends from the end on the back side Dwb of the side end channel 83*pb* to the back side Dpp, and communicates with the third blade channel 71*c*. The side end channel 83*pb* of the second front side platform channel 81*pb* and the side end channel 83*pa* of the first front side platform channel 81*pa* both extend in the direction along the front side end surface 63*p*, as described above. Furthermore, the side end channel 83*pb* of the second front side platform channel 81*pb* and the side end channel 83*pa* of the first front side platform channel 81*pa* are aligned in a perspective direction with respect to the front side end surface 63*p*. The side end channel 83*pa* of the first front side platform channel 81*pa* is positioned on the side closer to the front side end surface 63*p* than the side end channel 83*pb* of the second front side platform channel 81*pb*, and forms the outside channel. Furthermore, the side end channel 83*pb* of the second front side platform channel 81*pb* is positioned on the side farther to the side end channel 83*pa* of the first front side platform channel 81*pa* than the front side end surface 63*p*, and forms the inside channel. Note that the front side end channel 63*p* of the platform 60 which is the end plate forms the partial end surface for the side end channel 83*pa* of the first front side platform channel 81*pa* and the side end channel 83*pb* of the second front side platform channel 81*pb*.

Furthermore, a side end skirt hole 76*p* and a front side skirt hole 77*p* are formed in the platform 60.

The side end skirt hole 77*p* communicates with the side end channel 83*pa* in the first front side platform channel 81*pa*. The side end skirt hole 77*p* extends from the side end channel 83*pa* to the reverse gas path side Dwha, and opens at the reverse gas path surface 62 of the platform 60. The front side skirt hole 76*p* communicates with the side end channel 83*pb* in the second front side platform channel 81*pb*. The front side skirt hole 76*p* extends from the side end channel 83*pb* of the second front side platform channel 81*pb* to the front side Dpp, passes through the reverse gas path side Dwha to the side end channel 83*pa* of the first front side platform channel 81*pa*, and opens at the front side end surface 63*p* of the platform 60. Therefore, as seen from the blade height direction Dwh, the front side skirt hole 76*p* appears to intersect with the side end channel 83*pa* of the first front side platform channel 81*pa*. The openings of the skirt holes 76*p*, 77*p* are locked by plugs 78.

As described above, if two channels are aligned in the perspective direction with respect to the end surface, the two channels do not necessarily form one serpentine channel, and the skirt holes may be formed to extend from the inside channel of the two channels toward the end surface.

Note that the present variation is an example where the front side platform channel 81*p* of the first embodiment was changed, but the back side platform channel 81*n* in the first embodiment may be changed similar to the variation described above. Furthermore, with the present variation, similar to the first variation, the opening of the skirt hole is not required to be plugged by the plug 78. Furthermore, with the present variation, the form of the skirt hole can be the form of the second variation or the third variation.

Second Embodiment of the Rotating Blade

A second embodiment of the rotating blade will be described with reference to FIG. 13 to FIG. 16.

Figure 13:
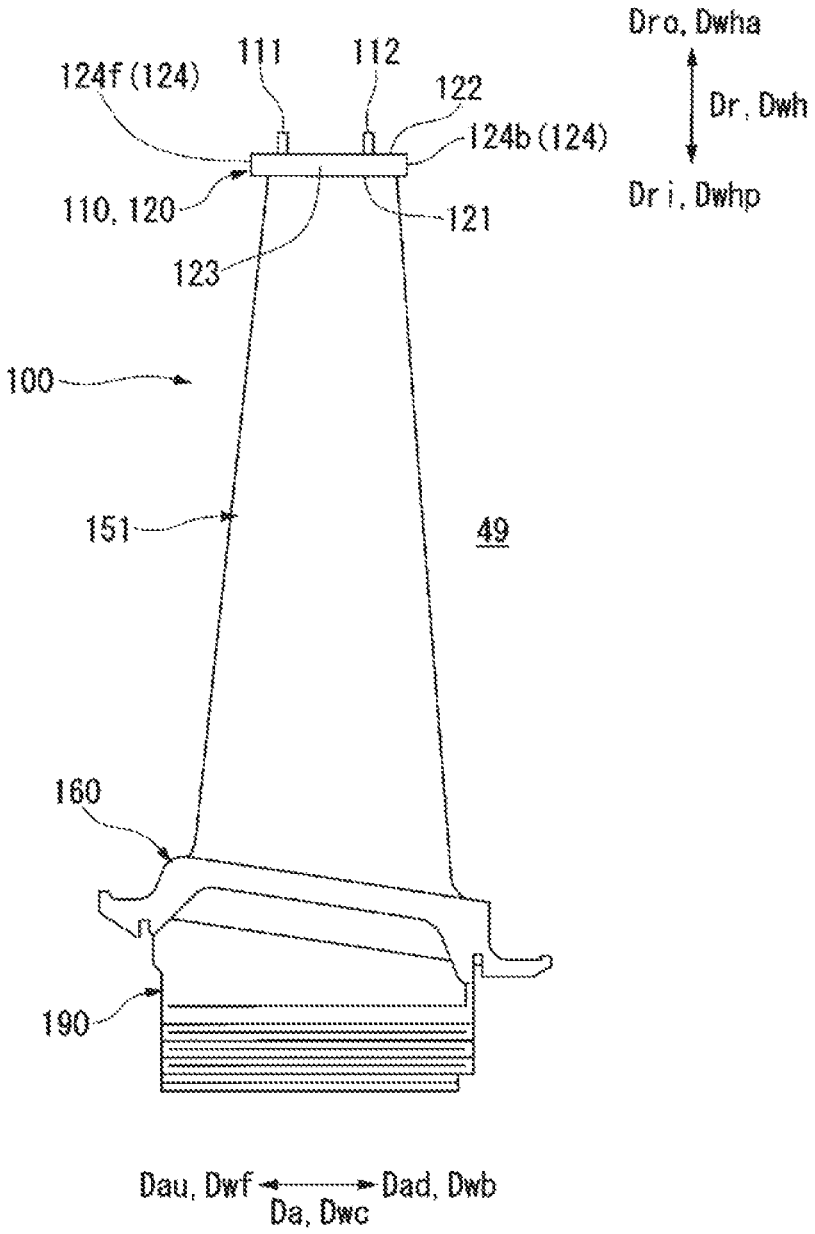
FIG. 13 is a side surface view of the rotating blade according to the second embodiment of the present invention.

As illustrated in FIG. 13, the rotating blade 100 of the present embodiment includes a blade body 151 with an airfoil shape, a platform 160 provided on an end portion of the blade body 151 in the blade height direction Dwh, and a shaft attachment part 190 that extends to the opposite side as the blade body 151 from the platform 160. Furthermore, the rotating blade 100 has a tip shroud 110 provided on one end portion of the blade body 151 in the blade height direction Dwh. With this rotating blade 100, the platform 160 and the tip shroud 110 are both end plates provided on the end of the blade body 151 in the blade height direction Dwh. This type of rotating blade 100 is used as a rotating blade that forms a downstream side rotating blade row, of the plurality of rotating blade rows of the turbine, for example.

Figure 14:
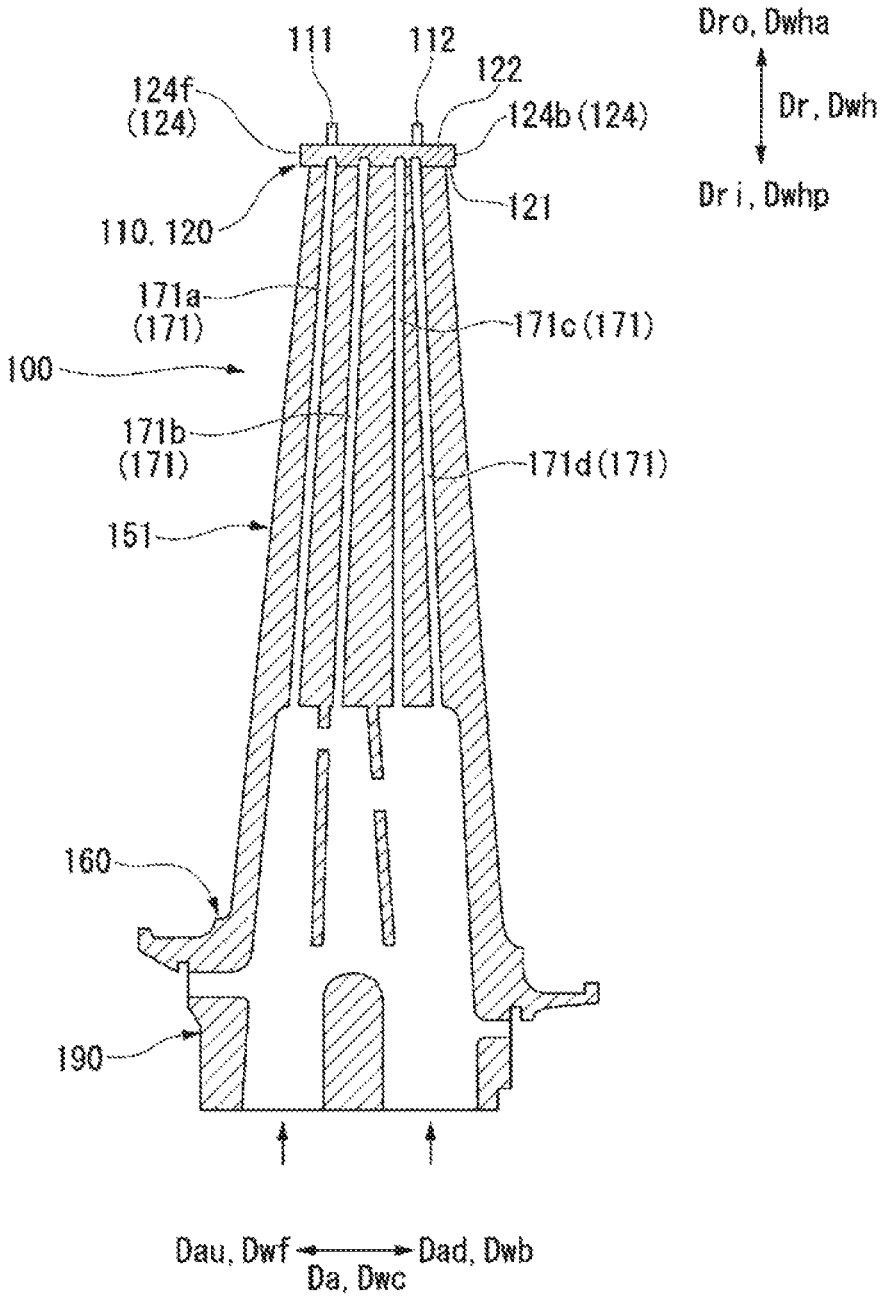
FIG. 14 is a cross-sectional view of the rotating blade according to the second embodiment of the present invention.

As illustrated in FIG. 14, a plurality of blade channels 171 that extend in the blade height direction Dwh are formed in the rotating blade 100 of the present embodiment. All of the blade channels 171 are formed continuous to the tip shroud 110, blade body 151, platform 160, and shaft attachment part 190.

Although not illustrated in the drawings, similar to the rotating blade 50 of the first embodiment, the platform channel and the skirt holes are formed in the platform 160.

The tip shroud 110 has a plate shaped shroud body 120 that extends from the end portion of the blade height direction Dwh in a direction with a perpendicular component to the blade height direction Dwh, a first tip fin 111 provided in the shroud body 120, and a second tip fin 112.

A gas path surface 121 facing the combustion gas channel 49 side, a reverse gas path surface 122 with a back matching relationship to the gas path surface 121, and end surfaces 123, 124 are formed in the shroud body 120. The gas path surface 121 of the shroud body 120 is a surface that extends in a direction having a perpendicular component with respect to the blade height direction Dwh. Herein, in the shroud body 120, the side where the gas path surface 121 exists with respect to the reverse gas path surface 122 in the blade height direction Dwh is the gas path side Dwhp, and the opposite side is the reverse gas path side Dwha. However, in a condition where the rotating blade 100 is attached to the rotor shaft, the gas path side Dwhp in the platform 160 is the radial direction outer side Dro, and the reverse gas path side Dwha is the radial direction inward side Dri, but the gas path side Dwhp in the shroud body 120 is the radial direction inward side Dri, and the reverse gas path side Dwha is the radial direction outward side Dro.

Figure 15:
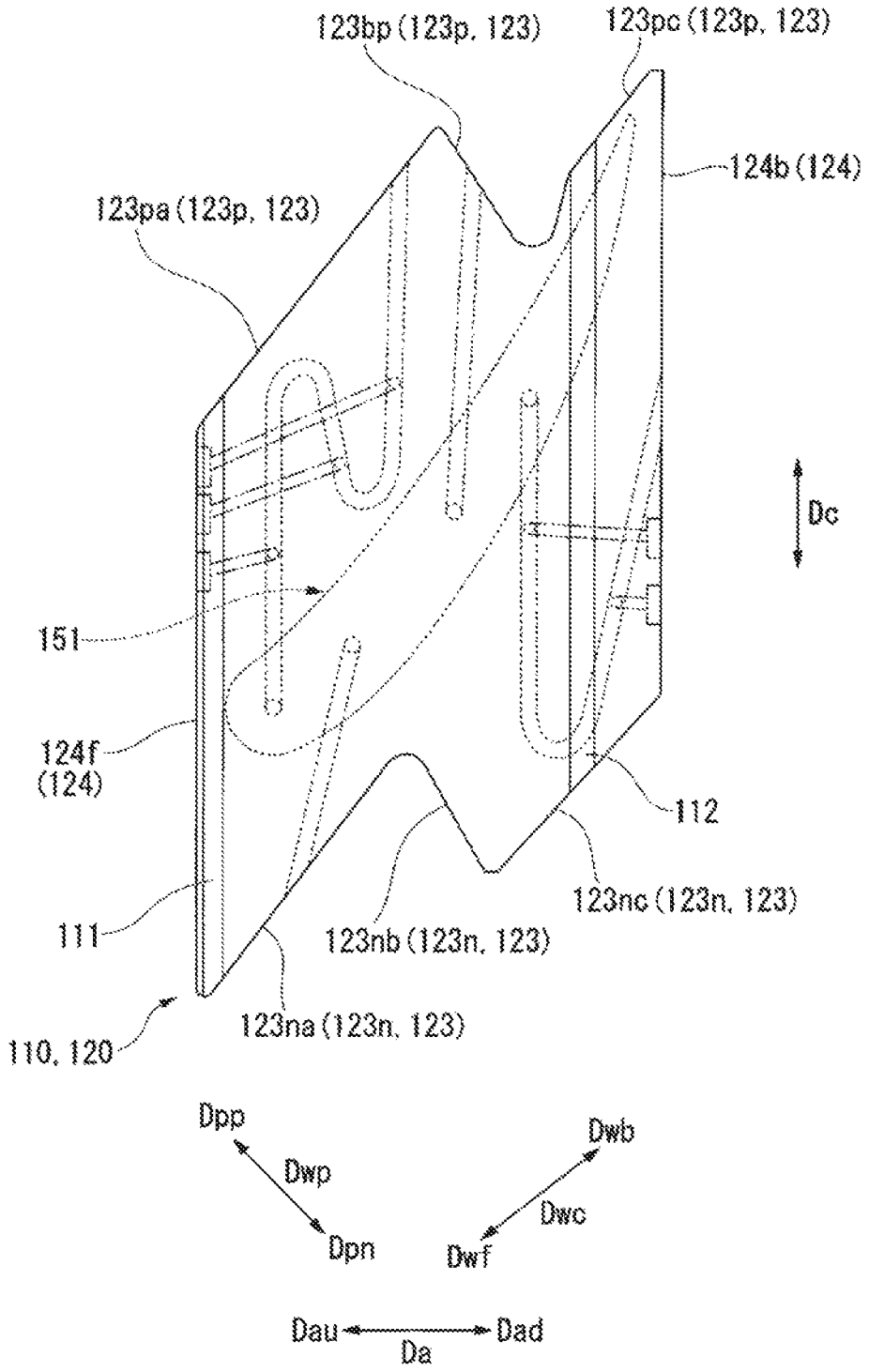
FIG. 15 is a plan view of a tip shroud according to the second embodiment of the present invention.

The first tip fin 111 and the second tip fin 112 both protrude from the reverse gas path surface 122 of the shroud body 120 to the reverse gas path side Dwha. The first tip fin 111 and the second tip fin 112 both extend in the circumferential direction Dc as illustrated in FIG. 15, in a condition where the rotating blade 100 is attached to the rotor shaft. The first tip fin 111 is positioned to the front side Dwf of the second tip fin 112.

The end surfaces 123, 124 of the shroud body 120 include a pair of front and back end surfaces 124 that face mutually opposing sides in the blade chord direction Dwc, and a pair of side end surfaces 123 facing mutually opposing sides in the width direction Dwp having a component perpendicular to the blade height direction Dwh and the blade chord direction Dwc. The pair of front and back end surfaces 124 both extend in the direction having a perpendicular component to the blade chord direction Dwc, and connect to the gas path surface 121. Of the pair of front and back end surfaces 124, one of the front and back end surfaces 124 forms the front end surface 124*f*, and the other front and back end surface 124 forms the back end surface 124*b*. The front end surface 124*f* exists on the front side Dwf with respect to the back end surface 124*b*. The pair of front and back end surfaces 124 extends in the circumferential direction Dc in a condition where the rotating blade 100 is attached to the rotor shaft.

Of the pair of side end surfaces 123, a first side end surface 123 forms a back side end surface 123*n*, and the second side end surface 123 forms a front side end surface 123*p*. The back side end surface 123*n* exists on the back side Dpn with respect to the front side end surface 123*p*. The back side end surface 123*n* has a back side first end surface 123*na*, a back side second end surface 123*nb*, and a back side third end surface 123*nc*. Furthermore, the front side end surface 123*p* has a front side first end surface 123*pa*, a front side second end surface 123*pb*, and a front side third end surface 123*pc*. The back side first end surface 123*na* and the front side first end surface 123*pa* are mutually parallel. The back side second end surface 123*nb* and the front side second end surface 123*pb* are mutually parallel. The back side third end surface 123*nc* and the front side third end surface 123*pc* are mutually parallel. The back side first end surface 123*na* and the front side first end surface 123*pa* both extend essentially in the blade chord direction Dwc. The back side second end surface 123*nb* extends from the end on the back side Dwh of the back side first end surface 123*na* to essentially the back side Dpn. The back side second end surface 123*pb* extends from the end on the back side Dwh of the front side first end surface 123*pa* to essentially the front side Dpn. The back side third end surface 123*nc* extends from the end on the back side Dpn of the back side second end surface 123*nb* to essentially the blade chord direction Dwc. The back side third end surface 123*pc* extends from the end on the back side Dpn of the front side second end surface 123*pb* to essentially the blade chord direction Dwc. Note that the phrase "extending essentially in the blade chord direction Dwc" refers to a condition where of the blade chord direction Dwc component, blade height direction Dwh component, and the width direction Dwp component, the blade chord direction Dwc component is the largest.

Figure 16:
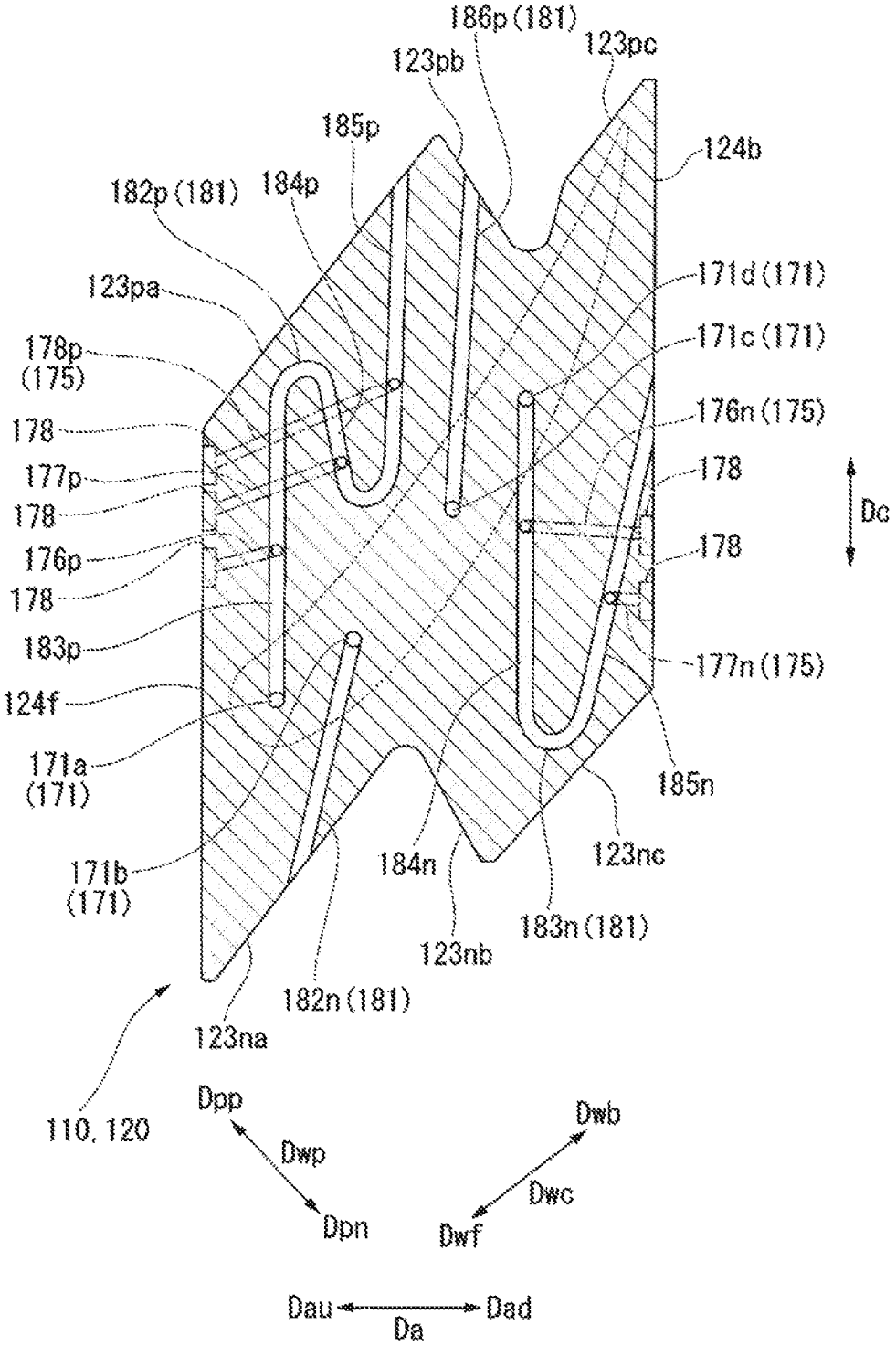
FIG. 16 is a cross-sectional view of a tip shroud according to the second embodiment of the present invention.

As illustrated in FIG. 14, four blade channels 171 are provided in the shroud body 120. The four blade channels 171 are aligned along the camber line of the blade body 151. As illustrated in FIG. 16, a shroud channel 181 and a skirt hole 175 are formed in the shroud body 120.

The shroud channel 181 includes a first back side shroud channel 182*n*, a second back side shroud channel 183*n*, a first front side shroud channel 182*p*, and a second front side shroud channel 186*p*.

The first back side shroud channel 182*n* communicates with the second of the second blade channels 171*b* of the four blade channels 171 from the front side Dwf. The first back side shroud channel 182*n* extends linearly from the second blade channel 171*b* toward the back side first end surface 123*na*, and opens at the back side first end surface 123*na*.

The second back side shroud channel 183*n* has a serpentine first channel 184*n* and a serpentine second channel 185*n*.

The serpentine first channel 184*n* and the serpentine second channel 185*n* both extend in the direction along the back end surface 124*b*. The serpentine first channel 184*n* and the serpentine second channel 185*n* both extend in the direction along the back end surface 124*b*. The serpentine second channel 185*n* is located on the side closer to the hack end surface 124*b* than the serpentine first channel 184*n*, and forms the outside channel. Furthermore, the serpentine first channel 184*n* is located on the side closer to the hack end surface 124*b* than the serpentine second channel 185*n*, and forms the inside channel. The serpentine first channel 184*n* and the serpentine second channel 185*n* mutually communicate at the back side Dpn. Therefore, one serpentine channel that zigzags in a direction along the back end surface 124*b* is formed by the serpentine first channel 184*n* and the serpentine second channel 185*n*. The serpentine second channel 185*n* opens at the back end surface 124*b* of the shroud body 120. Note, the back end surface 124*b* of the tip shroud 110 that is the end plate forms a partial end surface with respect to the serpentine first channel 184*n* and the serpentine second channel 185*n*. The end of the front side Dpp in the serpentine first channel 184*n* communicates with the fourth blade channel 171*d* on the back most side Dwb of the four blade channels 171.

The first front side shroud channel 182*p* has a serpentine first channel 183*p*, a serpentine second channel 184*p*, and a serpentine third channel 185*p*.

The serpentine first channel 183*p*, the serpentine second channel 184*p*, and the serpentine third channel 185*p* all extend in the direction along the front end surface 124*f*. The serpentine first channel 183*p*, the serpentine second channel 184*p*, and the serpentine third channel 185*p* are aligned in the perspective direction with respect to the front surface 124*f*. The serpentine first channel 183*p* is located on the side closer to the front end surface 124*f* than the serpentine second channel 184*p* and the serpentine third channel 185*p*, and forms the outside channel. Furthermore, the serpentine second channel 184*p* is located closer to the far side with respect to the front end surface 124*f* than the serpentine first channel 183*p*, and forms the inside channel. The serpentine third channel 185*p* is located to the far side with respect to the front end surface 124*f* than the serpentine second channel 184*p*, and forms the inside channel. The end of the back side Dpn in the serpentine first channel 183*p* communicates with the first blade channel 171*a* on the back most side Dwf of the four blade channels 171. The serpentine first channel 183*p* and the serpentine second channel 184*p* communicate with the corresponding end of the front side Dpp. Furthermore, the serpentine second channel 184*p* and the serpentine third channel 185*p* mutually communicate on each of the back side Dpn ends. Therefore, one serpentine channel that zigzags in a direction along the front side end surface 124*f* is formed by the serpentine first channel 183*p*, the serpentine second channel 184*p*, and the serpentine third channel 185*p*. The serpentine third channel 185*p* opens at the front side first end surface 123*pa* of the shroud body 120. Note, the front end surface 124*f* of the tip shroud 110 that is the end plate forms a partial end surface with respect to the serpentine first channel 183*p*, serpentine second channel 184*p*, and the serpentine third channel 185*p*.

The second front side shroud channel 186*p* communicates with the third of the third blade channels 171*c* of the four blade channels 171 from the front side Dwf. The second front side shroud channel 186*p* extends linearly from the third blade channel 171*c* toward the front side second end surface 123*pb*, and opens at the front side second end surface 123*pb*.

The skirt hole 175 has a back side first skirt hole 176*n*, a back side second skirt hole 177*n*, a front side first skirt hole 176*p*, a front side second skirt hole 177*p*, and front side third skirt hole 178*p*.

The back side first skirt hole 176*n* communicates with the serpentine first channel 184*n* in the second back side shroud channel 183*n*. The back side first skirt hole 176*n* extends from the serpentine first channel 184*n* to the back side Dwh, and opens on the back end surface 124*b* of the shroud body 120. The back side first skirt hole 176*n* passes to the reverse gas path side Dwha of the serpentine second channel 185*n* in the second back side shroud channel 183*n*. Therefore, as seen from the blade height direction Dwh, the back side first skirt hole 176*n* appears to intersect with the serpentine second channel 185*n* in the second back side shroud channel 183*n*.

The back side second skirt hole 177*n* communicates with the serpentine second channel 185*n* in the second back side shroud channel 183*n*. The back side first skirt hole 177*n* extends from the serpentine second channel 185*n* to the back side Dwh, and opens on the back end surface 124*b* of the shroud body 120.

The front side first skirt hole 176*p* communicates with the serpentine first channel 183*p* in the first front side shroud channel 182*p*. The front side first skirt hole 176*p* extends from the serpentine first channel 183*p* to the front side Dwf, and opens on the front end surface 124*f* of the shroud body 120.

The front side second skirt hole 177*p* communicates with the serpentine second channel 184*p* in the first front side shroud channel 182*p*. The front side second skirt hole 177*p* extends from the serpentine second channel 184*p* to the front side Dwf, and opens on the front end surface 124*f* of the shroud body 120. The front side second skirt hole 177*p* passes to the reverse gas path side Dwha of the serpentine first channel 183*p* in the first front side shroud channel 182*p*. Therefore, as seen from the blade height direction Dwh, the front side second skirt hole 177*p* appears to intersect with the serpentine first channel 183*p* in the first front side shroud channel 182*p*.

The front side third skirt hole 178*p* communicates with the serpentine third channel 185*p* in the first front side shroud channel 182*p*. The front side third skirt hole 178*p* extends from the serpentine third channel 185*p* to the front side Dwf, and opens on the front end surface 124*f* of the shroud body 120. The front side third skirt hole 178*p* passes to the reverse gas path side Dwha of the serpentine first channel 183*p* and the serpentine second channel 184*p* in the first front side shroud channel 182*p*. Therefore, as seen from the blade height direction Dwh, the front side third skirt hole 178*p* appears to intersect with the serpentine first channel 183*p* and the serpentine second channel 184*p* in the first front side shroud channel 182*p*.

The opening of the shroud holds 175 are plugged by plugs 178 where a through hole (not illustrated in the drawings) is formed.

Herein, even if the shroud hole 175 that is formed in the shroud body 120 is open at the reverse gas path surface 122 of the shroud body 120, the opening is plugged by the plug. The reverse gas path surface 122 of the shroud body 120 faces the radial direction outer side in a condition where the rotating blade 100 is attached to the rotor shaft. The centrifugal force toward the outer side in the radial direction acts on the plug when the gas turbine rotor rotates. Furthermore, a plug that plugs the opening in the reverse gas path surface 122 is easily removed to the outer side in the radial direction by the centrifugal force.

On the other hand, with the present embodiment, the shroud hole 175 that is formed in the shroud body 120 is open at the partial end surface 124 of the shroud body 120. Therefore, when the gas turbine rotates and the centrifugal force acts toward the outer side in the radial direction with respect to the plug 178 to move the plug 178 to the outer side in the radial direction, the plug 178 is received by the inner surface of the shroud hole 175 and therefore removing the plug from the shroud hole 175 is difficult. Therefore, with the present embodiment, damage to the tip shroud 110 can be suppressed.

Furthermore, with the present embodiment, the partial end surface 124 can be cooled by the cooling air discharged from the partial end surface 124 of the shroud body 120.

Note, similar to the opening of the shroud hole of the platform 60 in the first variation, the opening of the shroud hole 175 of the shroud body 120 in the present embodiment is not necessarily plugged by the plug.

Furthermore, similar to the shroud hole of the platform 60 in the first embodiment, the skirt hole 175 of the shroud body 120 of the present embodiment may include the first extended part that extends from the inside channel in the serpentine channel to the reverse gas path side Dwha and the second extended part that extends from the in part of the reverse gas path side Dwha in the first extending part toward the partial end surface 124 side and opens at the partially end surface 124. Furthermore, similar to the skirt hole of the platform 60 in the second variation, the skirt hole 175 of the shroud body 120 in the present embodiment may have an tilted hole part that gradually linearly extends to the side near the side of the reverse gas path surface 122 when moving from the inside channel in the serpentine channel toward the partial end surface 124. Furthermore, similar to the third variation, with the present embodiment, the inside channel in the serpentine channel can have an extended part that extends to the reverse gas path side Dwha, and the skirt hole can extend linearly from the inner surface of the partial end surface 124 side of the inner surface in the extended part toward the partially end surface 124 of the shroud body 120 essentially parallel to the gas path surface 121.

Furthermore, the aforementioned embodiments and variations all apply the present invention to a rotating blade. However, the present invention can be applied to a vane. In other words, similar to the aforementioned embodiments and variations, an inside channel, outside channel, and skirt hole can be formed in the outside shroud (end plate) or the inside shroud (end plate) of the vane.

INDUSTRIAL APPLICABILITY

According to one aspect of the present invention, the high stress that occurs in the blade can be suppressed.

REFERENCE SIGNS LIST

10 Gas turbine
11 Gas turbine rotor
15 Gas turbine casing
20 Compressor
21 Compressor rotor
25 Compressor casing
30 Combustor
40 Turbine
41 Turbine rotor
42 Rotor shaft
43 Blade row
45 Turbine casing
46 Vane row
46*a* Vane
49 Combustion gas flow channel
50, 50*a*, 50*b*, 50*c*, 50*d*, 50*z*, 100 Rotating blades (or simply blades)
51, 151 Blade body
52 Leading edge

53 Trailing edge
54 Back side surface
55 Front side surface
60, 160 Platform (end plate)
61, 121 Gas path surface
62, 122 Reverse gas path surface
63, 64, 123, 124 End surface
63, 123 Side end surface
63*n*, 123*n* Back side end surface
63*p*, 123*p* Front side end surface (partial end surface)
64, 124 Front and back end surfaces
64*f*, 124*f* Front end surface
64*b*, 124*b* Back end surface (partial end surface)
71, 171 Blade channel
71*a*, 171*a* First blade channel
71*b*, 171*b* Second blade channel
71*c*, 171*c* Third blade channel
171*d* Fourth blade channel
75*n* Side end skirt hole
75*p*, 75*pc*, 75*pe* Front side first skirt hole (skirt hole)
75*pa* First extending part
75*pb* Second extending part
75*pd* Tilted hole part
76*n* Back side first skirt hole
76*p* Front side second skirt hole
77*n* Back side second skirt hole
77*p* Front side third skirt hole (or front side skirt hole)
78, 178 Plug
79 Through hole
81 Platform channel
81*n* Back side platform channel
81*p* Front side platform channel
81*pa* First front side platform channel
81*pb* Second front side platform channel
82*n*, 82*p*, 82*pa*, 82*pb* Intake channel
83*n*, 83*pa*, 83*pb* Side end channel
83*p*, 84*n* Serpentine first channel (inside channel)
84*pa*, 84*pb* Discharge channel
83*pe* Expansion part
84*p* Serpentine second channel (inside channel)
85*n* Serpentine second channel (outside channel)
85*p* Serpentine third channel (outside channel)
90, 190 Shaft attachment part
91 Shank
92 Blade base
95 Mold
96 Blade channel core
97 Platform channel core
98 Skirt core
110 Tip shroud
111 First tip fin
112 Second tip fin
120 Shroud body
175 Skirt hole
176*n* Back side first skirt hole
176*p* Front side first skirt hole
177*n* Back side second skirt hole
177*p* Front side second skirt hole
178*p* Front side third skirt hole
181 Shroud channel
182*p* First front side shroud channel
182*n* First back side shroud channel
183*n* Second back side shroud channel
186*p* Second front side shroud channel
Ac Cooling air
G Combustion gas
Da Axial direction
Dau Upstream side
Dad Downstream side
Dc Circumferential direction
Dr Radial direction
Dri Radial direction inner side
Dro Radial direction outer side
Dwc Chord direction
Dwf Front side
Dwb Back side
Dwh Blade height direction
Dwhp Gas path side
Dwha Reverse gas path side
Dwp Width direction
Dpn Back side
Dpp Front side
Lca Camber line
Lco Chord

The invention claimed is:

1. A blade, comprising:

a blade body having an airfoil shape disposed in a combustion gas channel in which combustion gas flows; and an end plate formed on an end portion in a blade height direction of the blade body;

the end plate including:

a gas path surface facing toward the combustion gas channel;

a reverse gas path surface facing toward an opposite of the gas path surface;

an end surface along an edge of the gas path surface;

a plurality of channels that extend in a direction along the gas path surface, disposed between the gas path surface and the reverse gas path surface; and a skirt hole opened on a partial end surface that is a portion of the end surface, wherein the plurality of channels are aligned in a perspective direction with respect to the partial end surface, the skirt hole communicates with an inside channel farther from the partial end surface than an outside channel closer to the partial end surface, of the plurality of channels, and a portion of the skirt hole overlaps with the outside channel as viewed from the blade height direction, and a position in the blade height direction of the portion of the skirt hole differs from a position in the blade height direction of the outside channel.

2. The blade according to claim 1, wherein the skirt hole passes on a side closer to the reverse gas path surface than the outside channel.

3. The blade according to claim 2, wherein the skirt hole includes a first extending part that extends from the inside channel toward the reverse gas path surface, and a second extending part that extends from an end portion closer to the reverse gas path surface toward the partial end surface, in the first extending part.

4. The blade according to claim 2, wherein the skirt hole includes a tilted hole part that gradually approaches the reverse gas path surface when approaching the partial end surface from the inside channel.

5. The blade according to claim 2, wherein the inside channel has an expanded part that expands more toward the reverse gas path surface than the outside channel, and the skirt hole communicates with the expanded part of the inside channel.

6. The blade according to claim 1, further comprising a plug that blocks the opening of the skirt hole in the partial end surface.

7. The blade according to claim 6, wherein the plug includes a through hole that externally discharges cooling air in the skirt hole.

8. The blade according to claim 1, wherein each of the plurality of channels extends in the direction along the partial end surface and communicates with a channel that is adjacent in the perspective direction, at an end in the direction along the partial end surface, and the plurality of channels mutually communicate forming one serpentine channel.

9. A gas turbine, comprising:

a plurality of the blades according to claim 1;

a rotor shaft to which a plurality of blades are attached;

a casing that covers the plurality of blades and the rotor shaft; and a combustor that transfers combustion gas to a region where the plurality of blades are disposed in the casing.

* * * * *